US011703053B2

(12) United States Patent
Yun et al.

(10) Patent No.: US 11,703,053 B2
(45) Date of Patent: Jul. 18, 2023

(54) SCROLL COMPRESSOR

(71) Applicant: LG ELECTRONICS INC., Seoul (KR)

(72) Inventors: Juhwan Yun, Seoul (KR); Nara Han, Seoul (KR); Mose Kang, Seoul (KR); Jihoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 17/512,967

(22) Filed: Oct. 28, 2021

(65) Prior Publication Data

US 2022/0136501 A1 May 5, 2022

(30) Foreign Application Priority Data

Nov. 4, 2020 (KR) ..... 10-2020-0146292

(51) Int. Cl.

| | |
|---|---|
| ***F01C 17/06*** | (2006.01) |
| ***F04C 18/02*** | (2006.01) |
| ***F04C 28/26*** | (2006.01) |
| ***F04C 29/00*** | (2006.01) |
| ***F04C 23/00*** | (2006.01) |
| ***F04C 29/06*** | (2006.01) |

(52) U.S. Cl.

CPC ..... *F04C 18/0215* (2013.01); *F04C 18/0261* (2013.01); *F04C 18/0269* (2013.01); *F04C 23/008* (2013.01); *F04C 29/068* (2013.01); *F04C 2240/30* (2013.01)

(58) Field of Classification Search

CPC ..... F04C 23/008; F04C 29/068; F04C 28/26; F04C 29/0057; F01C 17/066

See application file for complete search history.

(56) References Cited

U.S. PATENT DOCUMENTS

| | | | |
|---|---|---|---|
| 2003/0012659 | A1 | 1/2003 | Seibel et al. |
| 2005/0265880 | A1 | 12/2005 | Chang et al. |
| 2012/0107163 | A1 | 5/2012 | Monnier et al. |

(Continued)

FOREIGN PATENT DOCUMENTS

| | | |
|---|---|---|
| CN | 108457856 | 8/2018 |
| CN | 210050030 | 2/2020 |

(Continued)

OTHER PUBLICATIONS

English translation of WO-20120613 by PE2E search engine, Jun. 22, 2022.*

(Continued)

*Primary Examiner* — Deming Wan

(74) *Attorney, Agent, or Firm* — Ked & Associates

(57) ABSTRACT

A scroll compressor is provided that may include a casing, a drive motor, an orbiting scroll, a non-orbiting scroll, and a floating plate provided with a cover portion to cover an area between an outer wall portion and an inner wall portion of the non-orbiting scroll so as to form a back pressure chamber with the non-orbiting scroll, and a valve accommodating portion that extends from the cover portion so as to accommodate a discharge valve configured to open and close a discharge port. Accordingly, structure for forming a back pressure chamber is simplified to thereby reduce the number of components and man-hours required for assembly.

23 Claims, 10 Drawing Sheets

(56) References Cited

U.S. PATENT DOCUMENTS

| | | | | |
|---|---|---|---|---|
| 2015/0192121 | A1 | 7/2015 | Sung et al. | |
| 2015/0316058 | A1 | 11/2015 | Jin et al. | |
| 2015/0345493 | A1 | 12/2015 | Lochner et al. | |
| 2019/0277284 | A1 * | 9/2019 | Sun | F04C 28/26 |
| 2019/0383288 | A1 | 12/2019 | Jeon et al. | |

FOREIGN PATENT DOCUMENTS

| | | | | |
|---|---|---|---|---|
| CN | 210087602 | | 2/2020 | |
| EP | 3 653 835 | | 5/2020 | |
| JP | 2011236747 | | 11/2011 | |
| KR | 10-2015-0081691 | | 7/2015 | |
| KR | 10-2015-0098448 | | 8/2015 | |
| WO | WO-2012080613 | A2 * | 6/2012 | F04C 18/00 |
| WO | WO 2015125596 | | 8/2015 | |

OTHER PUBLICATIONS

European Search Report issued in Application No. 21205265.8 dated Mar. 30, 2022.
Korean Office Action issued in Application No. 10-2020-0146292 dated Nov. 9, 2021.
Chinese Office Action dated Apr. 28, 2023 issued in CN Application 202111294368.X.

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2020-0146292, filed in Korea on Nov. 4, 2020, the contents of which are incorporated by reference herein in their entirety.

BACKGROUND

1. Field

A scroll compressor is disclosed herein.

2. Background

In a scroll compressor, an orbiting scroll and a non-orbiting scroll are engaged to be coupled with each other, and as the orbiting scroll performs an orbiting motion with respect to the non-orbiting scroll, a pair of compression chambers is formed between the orbiting scroll and the non-orbiting scroll. Each compression chamber includes a suction pressure chamber formed at an outer edge, an intermediate pressure chamber sequentially formed while gradually decreasing in volume from the suction pressure chamber toward a central portion, and a discharge pressure chamber. The suction pressure chamber typically communicates with a refrigerant suction pipe through a side surface of the non-orbiting scroll, the intermediate pressure chamber is sealed, and the discharge pressure chamber is formed to communicate with a refrigerant discharge pipe through a center of an end plate of the non-orbiting scroll.

In the scroll compressor, as the pair of compression chambers is formed, the non-orbiting scroll and the orbiting scroll should be tightly sealed in an axial direction to suppress leakage between the pair of compression chambers. Thus, the scroll compressor has a back pressure structure in which the orbiting scroll is pressed toward the non-orbiting scroll, or conversely, the non-orbiting scroll is pressed toward the orbiting scroll. The former may be defined as an orbiting back pressure method, and the latter may be defined as a non-orbiting back pressure method.

In the orbiting back pressure method, a back pressure chamber is formed between an orbiting scroll and a main frame that supports the orbiting scroll, and in the non-orbiting back pressure method, a back pressure chamber is formed on a rear surface of a non-orbiting scroll. More particularly, in the non-orbiting back pressure method, a separately manufactured back pressure chamber assembly may be fastened to the rear surface of the non-orbiting scroll.

In general, the orbiting back pressure method is applied to a structure in which the non-orbiting scroll is fixed to the main frame, and the non-orbiting back pressure method is applied to a structure in which the non-orbiting scroll is axially movable with respect to the main frame. U.S. Patent Publication No. 2003/0012659 (hereinafter "Patent Document 1"), which is hereby incorporated by reference, discloses a scroll compressor to which the non-orbital back pressure method is applied.

In Patent Document 1, an annular back pressure chamber is formed on a back surface of a non-orbiting scroll, and a ring member forming an upper surface of the back pressure chamber is slidably inserted into the back pressure chamber. Accordingly, in Patent Document 1, the ring member moves up and down by a pressure of the back pressure chamber to adjust the pressure in the back pressure chamber. However, Patent Document 1 does not disclose a discharge valve configured as a kind of backflow prevention valve (hereinafter, defined as a discharge valve). Accordingly, in Patent Document 1, refrigerant discharged from a compression chamber to a discharge chamber may flow back into the compression chamber when the compressor is stopped, resulting in inhibiting restart.

U.S. Patent Publication No. US 2012/0107163 (hereinafter, "Patent Document 2"), which is hereby incorporated by reference, discloses an example in which a discharge valve for opening and closing a discharge port is installed in the non-orbiting scroll back pressure method. When a compressor is stopped, a discharge valve blocks refrigerant from flowing back from a discharge chamber to a compression chamber, so that the compressor can be quickly restarted. However, in Patent Document 2, as a back pressure chamber is integrally formed in a non-orbiting scroll like in Patent Document 1, there is no space to install a bypass valve. As a result, a bypass valve is not installed to thereby cause an over compression, and thus, efficiency and reliability of the compressor may be reduced.

U.S. Patent Publication No. US 2015/0345493 (hereinafter, "Patent Document 3"), which is hereby incorporated by reference, discloses an example in which a discharge valve and a bypass valve for opening and closing a discharge port are respectively installed in the non-orbiting scroll method. The discharge valve may block refrigerant from backflowing from a discharge chamber to a compression chamber when the compressor is stopped, and the bypass valve may discharge refrigerant in advance when the refrigerant is compressed due to an over compression to thereby prevent a decrease in efficiency and reliability of the compressor. In Patent Document 3, a back pressure chamber assembly including a back pressure chamber is separately manufactured to be assembled on an upper surface of a non-orbiting scroll.

This is because the back pressure chamber is installed at a position radially overlapping the bypass valve (or bypass hole) in order to secure an area of the back pressure chamber, and thus, the back pressure chamber assembly configured as a separate module is assembled to the non-orbiting scroll from an upper side of the bypass valve. However, as the back pressure chamber assembly is separately manufactured to be assembled, the number of components and assembly processes therefor may increase, resulting in an increase in manufacturing costs.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a scroll compressor according to embodiments disclosed herein, with reference to the accompanying drawings. In general, scroll compressors, like other compressors, may be classified into low-pressure compressors or high-pressure compressors according to which pressure portion is formed in an inner space of a casing, particularly a space accommodating a motor unit. In the former case, the space may form a low-pressure portion and a refrigerant suction pipe may communicate with the space. In the latter case, the space may form a high-pressure portion and the refrigerant suction pipe may be formed through the casing so as to be directly connected to a compression unit. This embodiment relates to a low-pressure scroll compressor.

Figure 1:
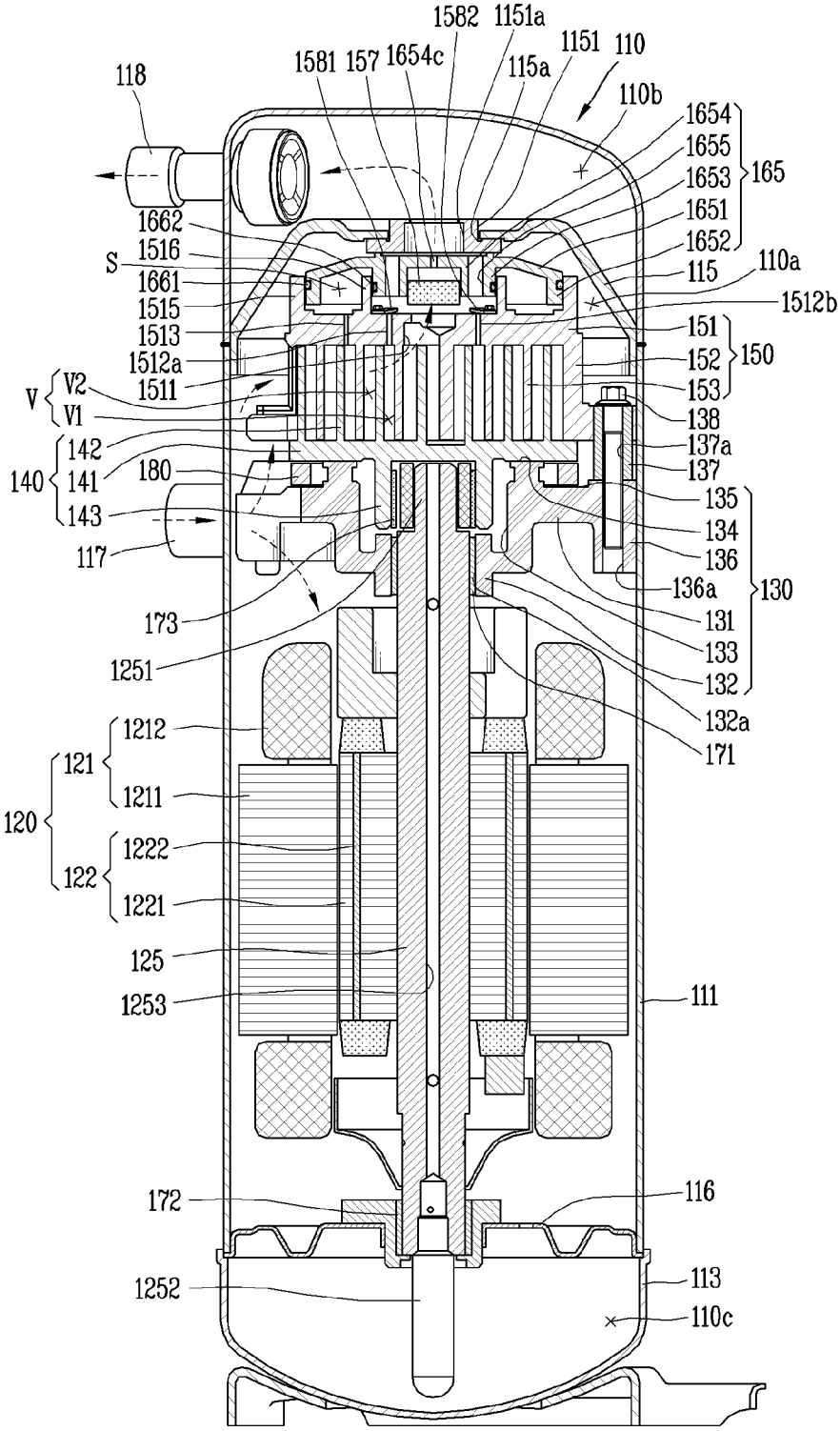
FIG. 1 is a longitudinal cross-sectional view of a capacity-variable scroll compressor in accordance with an embodiment.

FIG. 1 is a longitudinal cross-sectional view of a low-pressure type capacity-variable scroll compressor in accordance with an embodiment. Referring to FIG. 1, in the low-pressure capacity-variable scroll compressor (hereinafter, abbreviated as "scroll compressor") according to the embodiment, a drive motor 120 may be installed in a lower portion of the casing 110, and a main frame 130, an orbiting scroll 140, and a non-orbiting scroll 150 may be sequentially installed above the drive motor 120. In general, the drive motor 120 may constitute a motor unit, and the main frame 130, the orbiting scroll 140, and the non-orbiting scroll 150 may constitute a compression unit. The motor unit may be coupled to one or a first end of a rotational shaft 125, and the compression unit may be coupled to another or a second end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111 in an inserting manner. A terminal bracket (not shown) may be coupled to an upper portion of the cylindrical shell 111, and a terminal (not shown) that transmits external power to the drive motor 120 may be coupled through the terminal bracket. In addition, a refrigerant suction pipe 117 discussed hereinafter may be coupled to the upper portion of the cylindrical shell 111, for example, above the drive motor 120.

The upper cap 112 may be coupled to cover the open upper end of the cylindrical shell 111, and the lower cap 113 may be coupled to cover the open lower end of the cylindrical shell 111. A rim of a high and low pressure separation plate 115 discussed hereinafter may be inserted between the cylindrical shell 111 and the upper cap 112 to be, for example, welded to the cylindrical shell 111 and the upper cap 112, and a rim of a support bracket 116 discussed hereinafter may be inserted between the cylindrical shell 111 and the lower cap 113 to be, for example, welded to the cylindrical shell 111 and the lower cap 113. Accordingly, the inner space of the casing 110 may be sealed.

The rim of the high and low pressure separation plate 115, as discussed above, may be, for example, welded to the casing 110 and a central portion of the high and low pressure separation plate 115 may be bent into a truncated conic shape to protrude toward the upper cap 112 so as to be disposed above a back pressure chamber assembly 160 discussed hereinafter. A refrigerant suction pipe 117 may communicate with a space below the high and low pressure separation plate 115, and a refrigerant discharge pipe 118 may communicate with a space above the high and low pressure separation plate 115. Accordingly, a low-pressure portion 110*a* constituting a suction space may be formed below the high and low pressure separation plate 115, and a high-pressure portion 110*b* constituting a discharge space may be formed above the high and low pressure separation plate 115.

In addition, a through hole 115*a* may be formed through a center of the high and low pressure separation plate 115, and a sealing plate 1151 to which a floating plate 165 discussed hereinafter is detachably coupled may be inserted into the through hole 115*a*. Accordingly, the low-pressure portion 110*a* and the high-pressure portion 110*b* may be blocked from or communicate with each other by the floating plate 165 and the sealing plate 1151.

The sealing plate 1151 may be formed in an annular shape. For example, a high and low pressure communication hole 1151*a* may be formed through a center of the sealing plate 1151 so that the low-pressure portion 110*a* and the high-pressure portion 110*b* communicate with each other. The floating plate 165 may be attachable and detachable along a circumference of the high and low pressure communication hole 1151*a*. Accordingly, the floating plate 165 may be attached to or detached from the circumference of the high and low pressure communication hole 1151*a* of the sealing plate 1151 while moving up and down by back pressure in an axial direction. During this process, the low-pressure portion 110*a* and the high-pressure portion 110*b* may be sealed from each other or communicate with each other.

In addition, the lower cap 113 may define an oil storage space 110*c* together with the lower portion of the cylindrical shell 111 constituting the low-pressure portion 110*a*. In other words, the oil storage space 110*c* may be defined in the lower portion of the low-pressure portion 110*a*. The oil storage space 110*c* may define a portion of the low-pressure portion 110*a*.

Hereinafter, the drive motor will be described.

Referring to FIG. 1, the drive motor 120 according to this embodiment may be disposed under the low-pressure portion 110*a* and include a stator 121 and a rotor 122. The stator 121 may be, for example, shrink-fitted to an inner wall surface of the cylindrical shell 111, and the rotor 122 may be rotatably provided inside of the stator 121.

The stator 121 may include a stator core 1211 and a stator coil 1212. The stator core 1211 may be formed in a cylindrical shape and may be, for example, shrink-fitted onto the inner circumferential surface of the cylindrical shell 111. The stator coil 1212 may be wound around the stator core 1211 and may be electrically connected to an external power source through a terminal (not shown) coupled through the casing 110.

The rotor 122 may include a rotor core 1221 and permanent magnets 1222. The rotor core 1221 may be formed in a cylindrical shape, and may be rotatably inserted into the stator core 1211 with a preset or predetermined gap therebetween. The permanent magnets 1222 may be embedded in the rotor core 1221 at preset or predetermined intervals along a circumferential direction.

The rotational shaft 125 may be coupled to a center of the rotor 122. An upper end portion of the rotational shaft 125 may be rotatably inserted into the main frame 130 discussed hereinafter so as to be supported in a radial direction, and a lower end portion of the rotational shaft 125 may be rotatably inserted into the support bracket 116 so as to be supported in the radial and axial directions. The main frame 130 may be provided with a main bearing 171 that supports the upper end portion of the rotational shaft 125, and the support bracket 116 may be provided with a sub bearing 172 that supports the lower end portion of the rotational shaft 125. The main bearing 171 and the sub bearing 172 each may be configured as a bush bearing.

An eccentric portion 1251 that is eccentrically coupled to the orbiting scroll 140 discussed hereinafter may be formed on the upper end portion of the rotational shaft 125, and an oil feeder 1252 that absorbs oil stored in the lower portion of the casing 110 may be disposed in the lower end portion of the rotational shaft 125. An oil supply hole 1253 may be formed through the rotational shaft 125 in the axial direction.

Next, the main frame will be described.

The main frame 130 according to this embodiment may be disposed above the drive motor 120 and may be, for example, shrink-fitted or welded to an inner wall surface of the cylindrical shell 111. The main frame 130 may be formed of, for example, cast iron.

Referring to FIG. 1, the main frame 130 may include a main flange portion 131, a main bearing portion 132, an orbiting space portion 133, a scroll support portion 134, an Oldham ring accommodation portion 135, and a frame fixing portion 136. The main flange portion 131 may be formed in an annular shape and accommodated in the low-pressure portion 110*a* of the casing 110. An outer diameter of the main flange portion 131 may be formed smaller than an inner diameter of the cylindrical shell 111 so that an outer circumferential surface of the main flange portion 131 is spaced apart from an inner circumferential surface of the cylindrical shell 111. However, the frame fixing portion 136 discussed hereinafter may protrude from the outer circumferential surface of the main flange portion 131 in the radial direction, and an outer circumferential surface of the frame fixing portion 136 may be brought into close contact with and fixed to the inner circumferential surface of the casing 110. Accordingly, the main frame 130 may be fixedly coupled to the casing 110.

The main bearing portion 132 may protrude downward from a lower surface of a central portion of the main flange portion 131 toward the drive motor 120. The main bearing portion 132 may be provided with a cylindrical bearing hole 132*a* formed therethrough in the axial direction, and the main bearing 171 configured as the bush bearing may be fixedly coupled to an inner circumferential surface of the bearing hole 132 in an inserted manner. The rotational shaft 125 may be inserted into the main bearing 171 to be supported in the radial direction.

The orbiting space portion 133 may be recessed from the central portion of the main flange portion 131 toward the main bearing portion 132 with a predetermined depth and outer diameter. The orbiting space portion 133 may be larger than an outer diameter of a rotational shaft coupling portion 143 provided on the orbiting scroll 140 discussed hereinafter. Accordingly, the rotational shaft coupling portion 143 may be pivotally accommodated in the orbiting space portion 133.

The scroll support portion 134 may be formed in an annular shape on an upper surface of the main flange portion 131 along a periphery of the orbiting space portion 133. Accordingly, the scroll support portion 134 may support the lower surface of an orbiting end plate 141 discussed hereinafter in the axial direction.

The Oldham ring accommodation portion 135 may be formed in an annular shape on an upper surface of the main flange portion 131 along an outer circumferential surface of the scroll support portion 134. Accordingly, an Oldham ring 180 may be inserted into the Oldham ring accommodation portion 135 to be pivotable.

The frame fixing portion 136 may be formed to extend radially from an outer periphery of the Oldham ring accommodation portion 135. The frame fixing portion 136 may extend in an annular shape or may extend to form a plurality of protrusions spaced apart from one another at preset or predetermined intervals. This embodiment illustrates an example in which the frame fixing portion 136 has a plurality of protrusions along the circumferential direction.

For example, a plurality of the frame fixing portion 136 may be provided disposed at preset or predetermined intervals along the circumferential direction. The plurality of frame fixing portions 136 may be provided with bolt coupling holes 136*a*, respectively, that are formed therethrough in the axial direction.

The frame fixing portions 136 may be formed to correspond to respective guide protrusions 155 of non-orbiting scroll 150 discussed hereinafter in the axial direction, and the bolt coupling holes 136*a* may be formed to correspond to respective guide insertion holes 155*a* provided in the guide protrusions 155 in the axial direction.

An inner diameter of the bolt coupling hole 136*a* may be smaller than an inner diameter of guide insertion hole 155*a*. Accordingly, a stepped surface that extends from an inner circumferential surface of the guide insertion hole 155*a* may be formed on a periphery of an upper surface of the bolt coupling hole 136*a*, and a guide bush 137 that is inserted through the guide insertion hole 155*a* may be placed on the stepped surface so as to be supported on the frame fixing portion 136 in the axial direction.

The guide bush 137 may be formed in a hollow cylindrical shape through which the bolt insertion hole 137*a* may be formed in the axial direction. Accordingly, each guide bolt 138 may be inserted through the bolt insertion hole 137*a* of the guide bush 137 to be coupled to the bolt coupling hole 136*a* of the frame fixing portion 136. The non-orbiting scroll 150 may thus be slidably supported on the main frame 130 in the axial direction and fixed to the main frame 130 in the radial direction.

Hereinafter, the orbiting scroll will be described.

The orbiting scroll 140 according to this embodiment may be disposed on an upper surface of the main frame 130. Accordingly, it may be advantageous in terms of motor efficiency that the orbiting scroll 140 is formed of a hard material such as aluminum. In addition, as it is formed of a different material, from the main frame 130, which is cast iron, it may be advantageous in terms of wear resistance.

The orbiting scroll 140 may include an orbiting end plate 141, an orbiting wrap 142, and rotational shaft coupling portion 143. The orbiting end plate 141 may be formed approximately in a disk shape. An outer diameter of the orbiting end plate 141 may be mounted on the scroll support portion 134 of the main frame 130 to be supported in the axial direction.

The orbiting wrap 142 may be formed in a spiral shape that protrudes from an upper surface of the orbiting end plate 141 facing the non-orbiting scroll 150 by a predetermined height. The orbiting wrap 142 may correspond to non-orbiting wrap 153 to perform an orbiting motion by being engaged with non-orbiting wrap 153 of the non-orbiting scroll 150 discussed hereinafter. The orbiting wrap 142 may define a compression chamber V together with the non-orbiting wrap 153.

The compression chamber V may include first compression chamber V1 and second compression chamber V2 discussed hereinafter. The first compression chamber V1 may be formed at an outer surface of the non-orbiting wrap 153, and the second compression chamber V2 may be formed at an inner surface of the non-orbiting wrap 153. Each of the first compression chamber V1 and the second compression chamber V2 may include a suction pressure chamber (no reference numeral), an intermediate pressure chamber (no reference numeral), and a discharge pressure chamber (no reference numeral) that are consecutively formed.

The rotational shaft coupling portion 143 may protrude from a lower surface of the orbiting end plate 141 toward the main frame 130. The rotational shaft coupling portion 143 may be formed in a cylindrical shape, and an eccentric portion bearing 173 may be coupled to an inner circumferential surface of the rotational shaft coupling portion 143 in an inserted manner. The eccentric portion bearing 173 may be configured as a bush bearing.

A length of the rotational shaft coupling portion 143 may be shorter than a depth of the orbiting space portion 133, and an outer diameter of the rotational shaft coupling portion 143 may be smaller than an inner diameter of the orbiting space portion 133 by at least twice an orbiting radius. Accordingly, the rotational shaft coupling portion 143 may perform the orbiting motion while being accommodated in the orbiting space portion 133.

The Oldham ring 180 may be provided between the main frame 130 and the orbiting scroll 140 to restrict rotational motion of the orbiting scroll 140. As described above, the Oldham ring 180 may be slidably coupled to the main frame 130 and the orbiting scroll 140, respectively, or slidably coupled to the orbiting scroll 140 and the non-orbiting scroll 150, respectively.

Hereinafter, the non-orbiting scroll will be described.

The non-orbiting scroll 150 according to an embodiment may be disposed on the orbiting scroll 140 to define the compression chamber together with the orbiting scroll 140. Accordingly, it may be advantageous in terms of wear resistance that the non-orbiting scroll 150 is formed of cast iron, which is different from the material forming the orbiting scroll 140.

The non-orbiting scroll 150 may be fixedly coupled to the main frame 130, or may be coupled to the main frame 130 to be movable up and down. This embodiment illustrates an example in which the non-orbiting scroll 150 is coupled to the main frame 130 to be movable relative to the main frame 130 in the axial direction.

The non-orbiting scroll 150 may include non-orbiting end plate 151, non-orbiting side wall 152, and non-orbiting wrap 153. The non-orbiting end plate 151 may be formed in a disk shape and disposed in a horizontal direction in the low-pressure portion 110*a* of the casing 110. A discharge port 1511, a bypass hole 1512, and a back pressure hole 1513 may be formed through a central portion of the non-orbiting end plate 151 in the axial direction.

The discharge port 1511 may be located at a position at which a discharge pressure chamber (no reference numeral) of the first compression chamber V1 and a discharge pressure chamber (no reference numeral) of the second compression chamber V2 communicate with each other. Although not shown in the drawings, a discharge guide groove may be formed on an end of the discharge port 1511.

The bypass hole 1512 may include first bypass hole 1512*a* that communicates with the first compression chamber V1, and second bypass hole 1512*b* that communicates with the second compression chamber V2. The first bypass hole 1512*a* and the second bypass hole 1512*b* may be formed along the circumferential direction at a side of the discharge port 1511 which is formed at a center of the non-orbiting scroll 150. More specifically, the first bypass hole 1512*a* and the second bypass hole 1512*b* each may be formed between the discharge hole 1511 and an inner wall portion 1516 discussed hereinafter in the radial direction. More specifically, the first bypass hole 1512*a* and the second bypass hole 1512*b* each may be formed on an axial line the same as that of a discharge through hole 1655 discussed hereinafter, or may be formed at a position at least partially overlapping the discharge through hole 1655 in the radial direction or at a lower side of inner cover portion 1653 discussed hereinafter.

The first bypass hole 1512*a* and the second bypass hole 1512*b* each may be one hole, or at least two, for example, three or more holes. FIG. 1 illustrates an example in which the first bypass hole 1512*a* and the second bypass hole 1512*b* are each respectively configured as one hole.

For example, when the first bypass hole 1512*a* and the second bypass hole 1512*b* are each respectively a plurality of holes, the first bypass hole 1512*a* and the second bypass hole 1512*b* may be respectively arranged in a line, or may be arranged in a curve along a profile of the non-orbiting wrap 153.

In addition, inner diameters of the plurality of holes forming each of the first bypass hole 1512*a* and the second bypass hole 1512*b* may all be the same or may be different from one another. For example, an inner diameter of a hole in a middle among the plurality of holes may be larger than inner diameters of holes at opposite sides with respect to the hole in the middle. The plurality of holes respectively forming the first bypass hole 1512*a* and the second bypass hole 1512*b* may communicate with one another to form a rectangular shape, or the first bypass hole 1512*a* and the second bypass hole 1512*b* each may be formed as a single rectangular hole.

A first bypass valve 1581 may be installed at an end of the first bypass hole 1512*a*, and a second bypass valve 1582 may be installed at an end of the second bypass hole 1512*b*. More specifically, as the first bypass hole 1512*a* and the second bypass hole 1512*b* are formed on the same axial line same as that of the discharge through hole 1655 or formed at the position at the lower side of the inner cover portion 1653, the first bypass valve 1581 and the second bypass valve 1582 may also be located on the same axial line as that of the discharge through hole 1655 or installed at the lower side of the inner cover portion 1653.

The first bypass valve 1581 and the second bypass valve 1582 each may be a reed valve, one or a first end of which is fixed and another or a second end of which is free. More specifically, one or a first end of the first bypass valve 1581 and one or a first end of the second bypass valve 1582 each may be fixed to an upper surface of the non-orbiting end plate 151 by, for example, bolting, and another or a second end of the first bypass valve 1581 and another or a second of the second bypass valve 1582 each may be provided in a free state to open and close the end of the first bypass hole 1512*a* and the end of the second bypass hole 1512*b*, respectively.

The back pressure hole 1513 may be formed through the non-orbiting end plate 151 in the axial direction. The back pressure hole 1513 may be formed at a position that communicates with a plate side back pressure hole 1611*c*, which will be described later, and may communicate with the compression chamber V at an intermediate pressure, which is between a suction pressure and a discharge pressure.

The non-orbiting side wall 152 may extend annularly in the axial direction from a rim of a lower surface of the non-orbiting end plate 151. An outer diameter of the non-orbiting side wall 152 may be smaller than an inner diameter of the cylindrical shell 111. Accordingly, the non-orbiting scroll 150 of this embodiment may be spaced apart from an inner circumferential surface of the cylindrical shell 111 so as to axially move according to a difference between pressure at the compression chamber V and pressure at a back pressure chamber S, which will be described hereinafter.

A height of the non-orbiting side wall 152 may be substantially the same as a height of the non-orbiting wrap 153, and an outer circumferential surface of the non-orbiting side wall 152 may be provided with guide protrusion 155 that extends therefrom in the radial direction. The guide protrusion 155 may have the guide insertion hole 155*a* described above.

Figure 2:
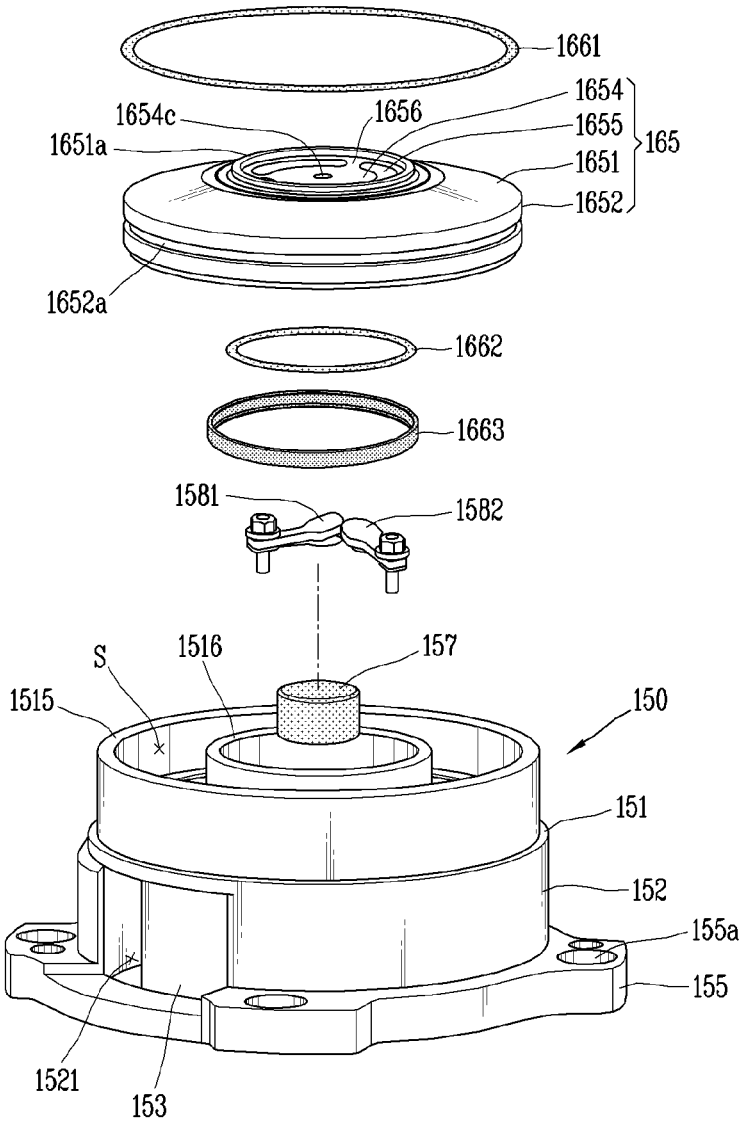
FIG. 2 is a perspective view illustrating a state in which a back pressure chamber portion is separated from a non-orbiting scroll in FIG. 1.
Figure 3:
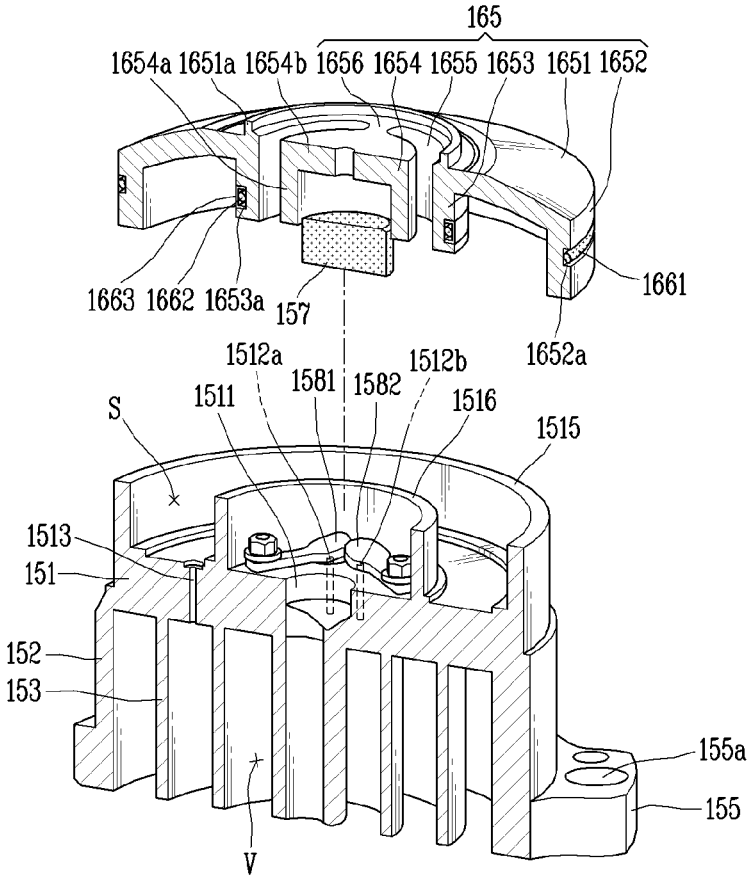
FIG. 3 is a perspective cross-sectional view illustrating a state in which the back pressure chamber portion is coupled to the non-orbiting scroll in FIG. 2.

A plurality of the guide protrusion 155 may be provided or a single guide protrusion. When the guide protrusion 155 is provided, the guide protrusions 155 may be disposed at predetermined intervals along the circumferential direction and each of the guide protrusions 155 may have one guide insertion hole 155*a*. When the guide protrusion 155 is provided as a single piece, a plurality of guide insertion holes 155*a* may be formed at predetermined intervals along the circumferential direction. FIGS. 2 and 3 illustrate a case in which a plurality of the guide protrusion 155 is provided.

One side of the outer circumferential surface of the non-orbiting side wall 152 may be provided with a suction port 1521. One or a first end of the suction port 1521 may communicate with the low-pressure portion 110*a* of the casing 110, and another or a second end of the suction port 1521 may communicate with the suction pressure chambers of the compression chambers V1 and V2. Accordingly, refrigerant may be suctioned into the low-pressure portion 110*a* of the casing 110 through the refrigerant suction pipe 117, and the refrigerant may be introduced into each of the suction pressure chambers through the suction port 1521.

The non-orbiting wrap 153 may extend in the axial direction from the lower surface of the non-orbiting end plate 151. The non-orbiting wrap 153 may be formed in a spiral shape at an inner portion of the non-orbiting side wall 152, and formed to correspond to the orbiting wrap 142 so as to be engaged with the orbiting wrap 142. Description of the non-orbiting wrap 153 will replaced with the description of the orbiting wrap 142. A back pressure chamber portion (no reference numeral) that presses the non-orbiting scroll 150 toward the orbiting scroll 140 may be integrally formed therewith on an upper surface of the non-orbiting scroll 150 according to this embodiment, namely, on the non-orbiting end plate 151.

Figure 4:
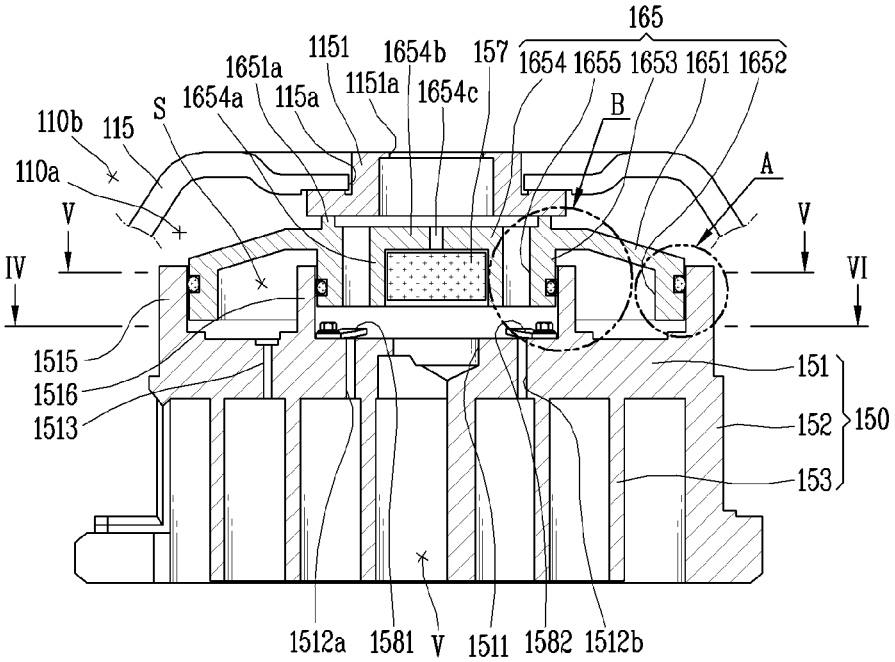
FIG. 4 is a longitudinal cross-sectional view of FIG. 3.
Figure 5:
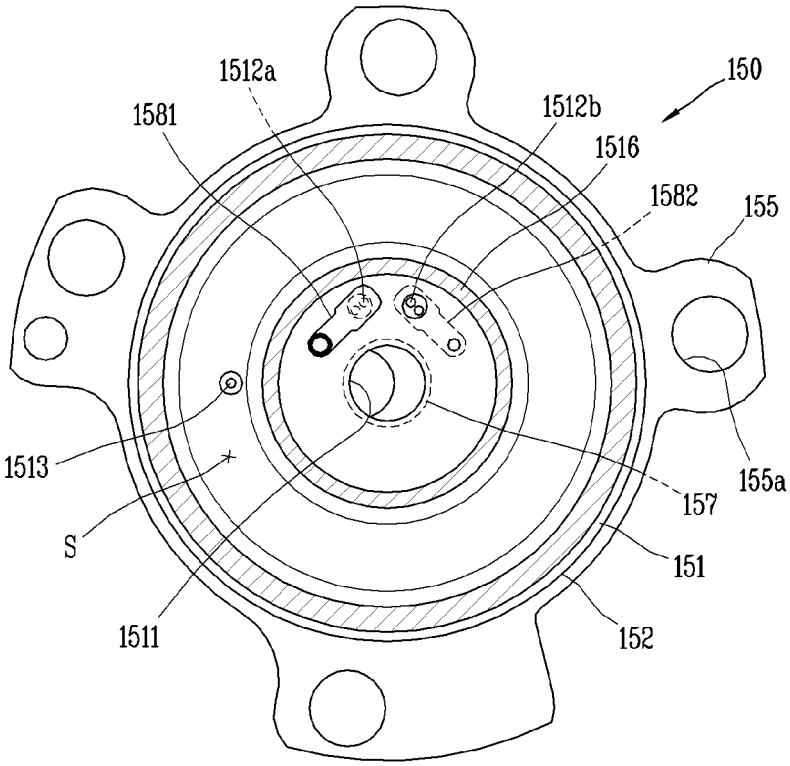
FIGS. 5 and 6 are cross-sectional views, taken along line "V-V" and line "VI-VI", respectively, in FIG. 4.
Figure 6:
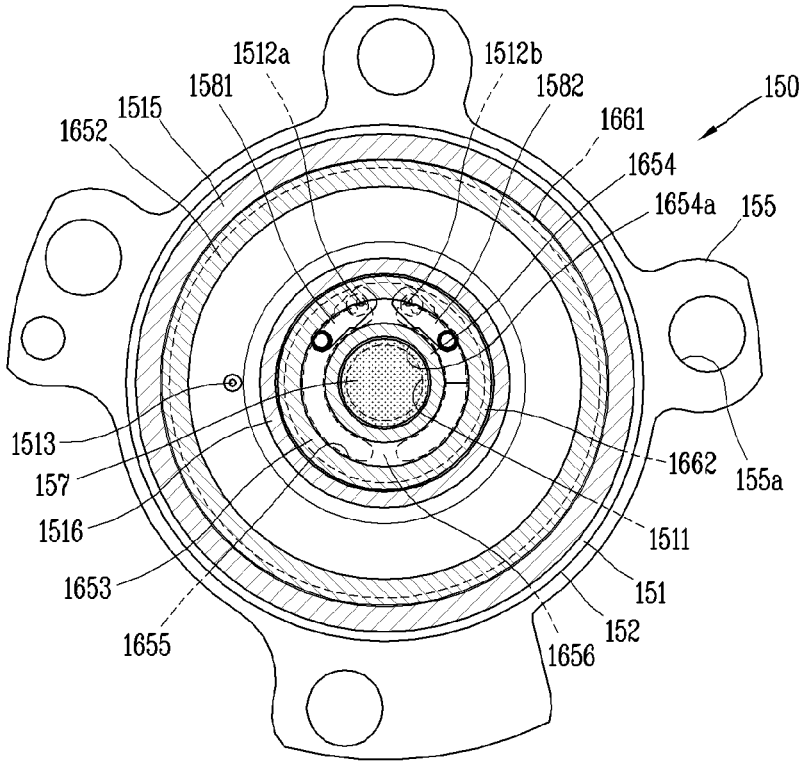
Figure 7:
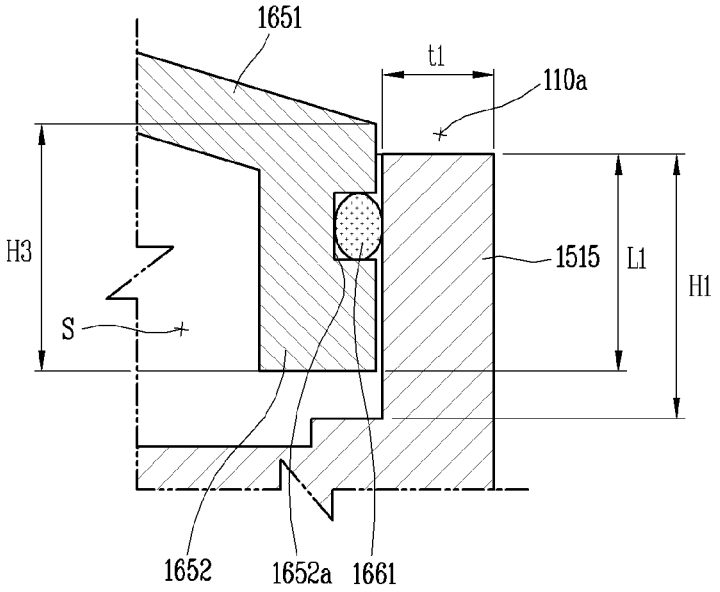
FIGS. 7 and 8 are enlarged cross-sectional views of portion "A" and portion "B" in FIG. 4.
Figure 8:
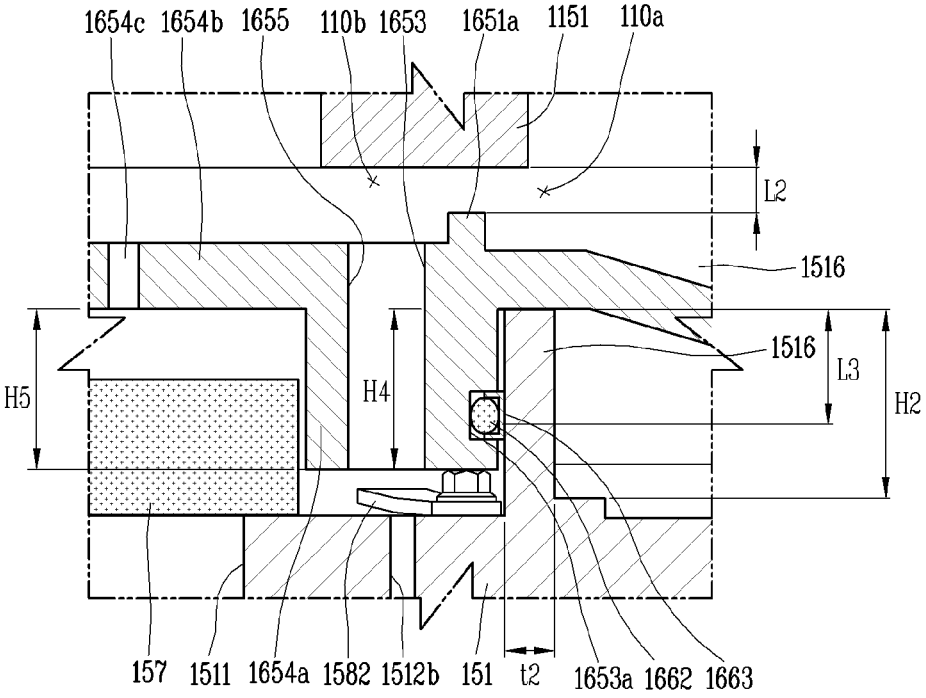

FIG. 2 is a perspective view illustrating a state in which a back pressure chamber portion is separated from a non-orbiting scroll in FIG. 1. FIG. 3 is a perspective cross-sectional view illustrating a state in which the back pressure chamber portion is coupled to the non-orbiting scroll in FIG. 2. FIG. 4 is a longitudinal cross-sectional view of FIG. 3. FIGS. 5 and 6 are cross-sectional views, taken along line "V-V" and line "VI-VI", respectively, in FIG. 4. FIGS. 7 and 8 are enlarged cross-sectional views of portion "A" and portion "B" in FIG. 4.

Referring to FIGS. 2 to 8, an outer wall portion 1515 and the inner wall portion 1516 forming a portion of the back pressure chamber portion may be formed on the upper surface of the non-orbiting end plate 151. The outer wall portion 1515 and the inner wall portion 1516 each formed in an annular shape may be radially spaced apart from each other with a predetermined gap therebetween. Accordingly, the back pressure chamber S may be formed between an inner circumferential surface of the outer wall portion 1515 and an outer circumferential surface of the inner wall portion 1516.

More specifically, the outer wall portion 1515 may define an outer wall surface of the back pressure chamber S, and the inner wall portion 1516 may define an inner wall surface of the back pressure chamber S. Accordingly, the upper surface of the non-orbiting end plate 151 disposed between the outer wall portion 1515 and the inner wall portion 1516 may define a bottom surface of the back pressure chamber S, and the back pressure hole 1513 described above may be formed between the outer wall portion 1515 and the inner wall portion 1516 defining the bottom surface of the back pressure chamber S.

In addition, referring to FIGS. 4 to 6, the discharge port 1511 described above may be formed at an approximately central position of the non-orbiting end plate 151, which is a center of the inner wall portion 1516, and the first bypass hole 1512*a* and the second bypass hole 1512*b* described above may be formed between the discharge hole 1511 and an inner circumferential surface of the inner wall portion 1516. Accordingly, while integrally forming the outer wall portion 1515 and the inner wall portion 1516 with the non-orbiting scroll 150, the back pressure hole 1513 as well as the first bypass hole 1512*a* and the second bypass hole 1512*b* may be formed in the non-orbiting scroll 150. This is because a valve accommodating portion 1654, which will be described hereinafter, is formed to extend in the axial direction in the floating plate 165.

The outer wall portion 1515 may extend upwardly from a rim of the upper surface of the non-orbiting end plate 151 toward the high and low pressure separation plate 115, and the inner wall portion 1516 may extend upwardly from a central portion of the upper surface of the non-orbiting end plate 151 toward the high and low pressure separation plate 115. As the outer wall portion 1515 and the inner wall portion 1516 are integrally formed to extend from the non-orbiting end plate 151, the outer wall portion 1515 and the inner wall portion 1516 may be made of cast iron like the non-orbiting end plate 151.

Referring to FIGS. 7 and 8, the inner wall portion 1516 and the outer wall portion 1515 may have substantially the same height (or axial length) and thickness. However, a height H1 of the outer wall portion 1515 and a height H2 of the inner wall portion 1516 may vary depending on shapes of the high and low pressure separation plate 115 and the floating plate 165 discussed hereinafter. For example, when the high and low pressure separation plate 115 is formed in a truncated conical shape and an outer circumferential surface of the floating plate 165 is internally inserted into the back pressure chamber S, the outer wall portion 1515 and the inner wall portion 1516 may have approximately the same height. However, when the high and low pressure separation plate 115 is formed in the truncated conical shape and the outer circumferential surface of the floating plate 165 is externally fitted to the back pressure chamber S, as illustrated in FIG. 4, discussed hereinafter, the height H1 of the outer wall portion 1515 may be shorter than the height H2 of the inner wall portion 1516.

A thickness t1 of the outer wall portion 1515 may be approximately equal to a thickness t2 of the inner wall portion 1516. However, the thickness t1 of the outer wall portion 1515 and the thickness t2 of the inner wall portion 1516 may be adjusted depending on whether a sealing member is provided.

For example, when the first sealing member 1661 and the second sealing member 1662 discussed hereinafter are respectively installed on the floating plate 165, the thickness t1 of the outer wall portion 1515 and the thickness t2 of the inner wall portion 1516 may be the same. On the other hand, when the first sealing member 1661 or the second sealing member 1662 is installed on the outer wall portion 1515 or the inner wall portion 1516, thicknesses t1 and t2 of wall portions on which the sealing members 1661 and 1662 are installed may be thicker than thicknesses t1 and t2 of wall portions on which the sealing members 1661 and 1662 are not installed.

The outer wall portion 1515 and the inner wall portion 1516 according to this embodiment may be formed substantially the same or the inner wall portion 1516 may be formed thinner than the outer wall portion 1515. Accordingly, there may be secured a space inside the inner wall portion 1516 large enough to fit the discharge port 1511 and the bypass hole 1512 described above.

Referring again to FIGS. 2 to 4, the back pressure chamber according to this embodiment may include the floating plate 165 slidably coupled to the non-orbiting scroll 150 in the axial direction. The floating plate 165 may be provided above the outer wall portion 1515 and the inner wall portion 1516 of the non-orbiting scroll 150 to cover an upper side of the back pressure chamber S, and slidably coupled to each of circumferential surfaces of the outer wall portion 1515 and the inner wall portion 1516. Accordingly, the back pressure chamber S may be sealed to be separated from the low-pressure portion 110*a* or the high-pressure portion 110*b* of the casing 110.

It is advantageous for the floating plate 165 to be formed of a material as light as possible so that the floating plate 165 may move up or down according to a change in back pressure during operation or stoppage of the compressor. For example, the floating plate 165 may be formed of engineering plastics. However, as the floating plate 165 collides with the sealing plate 1151 of the high and low pressure separation plate 115 while moving up in the axial direction during operation of the compressor, it may be advantageous for the floating plate 165 to be formed of a metal material as light as possible in terms of reliability. For example, the floating plate 165 may be formed of a surface-treated aluminum material.

The floating plate 165 may include upper cover portion 1651, outer cover portion 1652, inner cover portion 1653, valve accommodating portion 1654, and discharge through hole 1655. The upper cover portion 1651, the outer cover portion 1652, the inner cover portion 1653, and the valve accommodating portion 1654 may form a single body, and the discharge through hole 1655 may be an opening between the inner cover portion 1653 and the valve accommodating portion 1654.

The upper cover portion 1651 may have an annular shape, and may be larger than a gap between the outer wall portion 1515 and the inner wall portion 1516 of the non-orbiting scroll 150. Accordingly, the upper cover portion 1651 may cover a space between the outer wall portion 1515 and the inner wall portion 1516 forming the upper surface of the back pressure chamber S.

An outer surface of the upper cover portion 1651 may substantially correspond to a shape of a lower surface of the high and low pressure separation plate 115. For example, as the high and low pressure separation plate 115 is formed in a substantially truncated conical shape, the upper cover portion 1651 may be formed to be downwardly inclined from a center to a rim of the upper cover portion 1651. Accordingly, even when the floating plate 165 moves up, a maximum secured gap between the upper cover portion 1651 and the high and low pressure separation plate 115 may ensure smooth communication between the low-pressure portion 110*a* and the high-pressure portion 110*b* when the compressor is stopped.

An upper surface of an inner circumferential side of the upper cover portion 1651 may be provided with sealing protrusion 1651*a*. When the floating plate 165 moves up, the sealing protrusion 1651*a* may be brought into close contact with the sealing plate 1151 of the high and low pressure separation plate 115 to separate between the low-pressure portion 110*a* and the high-pressure portion 110*b*. The sealing protrusion 1651*a* may have an annular shape, and may be surface-hardened to prevent abrasion.

The sealing protrusion 1651*a* may be formed on an upper side of the inner cover portion 1653, namely, on an axial line the same as that of the inner cover portion 1653. Accordingly, the discharge through hole 1655 may be formed at an inner side of the sealing protrusion 1651*a*.

A height of the sealing protrusion 1651*a* may be formed to such an extent that a sufficient communication area is secured to allow refrigerant passing through the discharge through hole 1655 to smoothly move to the high-pressure portion 110*b* in a state in which the floating plate 165 is elevated during operation of the compressor. The outer cover portion 1652 may have an annular shape and extend from an outer circumference of the upper cover portion 1651 toward the non-orbiting scroll 150 in the axial direction.

Referring to FIG. 7, a height H3 of the outer cover portion 1652 may be formed to such an extent that a state in which the outer cover portion 1652 radially overlaps with the outer wall portion 1515 at a position at which the floating plate 165 is maximally elevated is maintained. For example, an outer maximum overlapping distance L1 between the outer cover portion 1652 and the outer wall portion 1515 may be greater than a maximum sealing distance L2 between the floating plate 165 and the high and low pressure separation plate 115. Accordingly, even when the floating plate 165 is maximally elevated, separation between the outer cover portion 1652 and the outer wall portion 1515 may be suppressed to thereby maintain a sealed state of the back pressure chamber S.

The outer cover portion 1652 may be slidably fitted to the inner circumferential surface of the outer wall portion 1515 or may be slidably fitted to the outer circumferential surface of the outer wall portion 1515. When the outer cover portion 1652 is internally fitted to the outer wall portion 1515, an outer diameter of the floating plate 165 may be reduced to thereby reduce a weight of the floating plate 165. Accordingly, during operation of the compressor, the floating plate 165 may be quickly elevated to separate the low-pressure portion 110*a* and the high-pressure portion 110*b*.

On the other hand, when the outer cover portion 1652 is externally fitted to the outer wall portion 1515, a back pressure area of the back pressure chamber S may be increased to thereby tightly seal the low-pressure portion 110*a* from the high-pressure portion 110*b*. In this embodiment, an example in which the outer cover portion 1652 is internally fitted to the outer wall portion 1515 will be described, and an example in which the outer cover portion 1652 is externally fitted to the outer wall portion 1515 will be described hereinafter as another embodiment.

When the outer cover portion 1652 is internally fitted to the outer wall portion 1515, outer cover member (hereinafter, "first sealing member") 1661 may be inserted in an outer circumferential surface of the outer cover portion 1652. For example, an outer sealing groove (hereinafter, a "first sealing groove") 1652*a* may be formed in an annular shape on the outer circumferential surface of the outer cover portion 1652, and the first sealing member 1661 may be inserted in the first sealing groove 1652*a*. The first sealing member 1661 may be configured as a sealing member having elasticity, such as an O-ring.

The first sealing member 1661 may be provided on the inner circumferential surface of the outer wall portion 1515 facing the outer circumferential surface of the outer cover portion 1652. However, as the outer wall portion 1515 extending from the non-orbiting end plate 151 is formed of cast iron, the outer wall portion 1515 has a relatively lower roughness than the outer cover portion 1652 of the floating plate 165 formed of aluminum. For this reason, when the first sealing groove 1652*a* is formed on the outer wall portion 1515 of the non-orbiting scroll 150, an assembly state of the first sealing member 1661 may be poor due to the low roughness. This may cause leakage from the back pressure chamber in which refrigerant leaks from the back pressure chamber S to the low-pressure portion 110*a* due to the poor sealing of an outer circumferential side of the back pressure chamber S. Accordingly, the first sealing member 1661 may be coupled to the first sealing groove 1652*a*, by forming the first sealing groove 1652*a* on the outer circumferential surface of the outer cover portion 1652 of the floating plate 165, which has a relatively higher roughness than the outer wall portion 1515 of the non-orbiting scroll 150.

Referring to FIG. 8, the inner cover portion 1653 may be formed to be substantially similar to the outer cover portion 1652. For example, the inner cover portion 1653 may be formed in an annular shape and extend from an inner circumference of the upper cover portion 1651 toward the non-orbiting scroll 150 in the axial direction. A height H4 of the inner cover portion 1653 may be formed to such an extent that a state in which the inner cover portion 1653 overlaps the inner wall portion 1516 in the axial direction at a position at which the floating plate 165 is elevated to a maximum height is maintained. For example, an inner maximum overlapping distance L3 between the inner cover portion 1653 and the inner wall portion 1516 may be greater than the maximum sealing distance L2 between the floating plate 165 and the high and low pressure separation plate 115. Accordingly, even when the floating plate 165 is maximally elevated, the inner cover portion 1653 may be suppressed from being separated from the inner wall portion 1516 to thereby maintain a sealed state of the back pressure chamber S.

The inner cover portion 1653 may be slidably fitted to the inner circumferential surface of the inner wall portion 1516 (or internally fitted to the inner wall portion 1516) or may be slidably fitted to the outer circumferential surface of the inner wall portion 1516 (or externally fitted to the inner wall portion 1516). When the inner cover portion 1653 is internally fitted to the inner wall portion 1516, an internal volume of the back pressure chamber S (or a back pressure area) may be increased. This may secure sufficient back pressure at the back pressure chamber S to thereby expand an operation range of the compressor.

On the other hand, when the outer cover portion 1652 is externally fitted to the outer wall portion 1515, an area of the discharge through hole 1655 discussed hereinafter may be expanded to reduce flow resistance to the refrigerant discharged to the high-pressure portion 110*b*. Accordingly, the refrigerant discharged from the compression chamber V through the discharge port 1511 may be rapidly discharged to the high-pressure portion 110*b*.

Alternatively, when a width of the discharge through hole 1655 is kept constant, a gap between an outer circumference of the discharge through hole 1655 and the inner cover portion 1654 may be increased. As this gap forms a surface that is pressurized by the discharged refrigerant, the back pressure area may be eventually increased to thereby quickly elevate the floating plate 165 during operation. In this embodiment, an example in which the inner cover portion 1653 is internally fitted to the inner wall portion 1516 will be described, and an example in which the inner cover portion 1653 is externally fitted to the inner wall portion 1516 will be described hereinafter as another embodiment.

When the inner cover portion 1653 is internally fitted to the inner wall portion 1516, the height H4 of the inner cover portion 1653 may be lower than the height H2 of the inner wall portion 1516. Accordingly, even when the first bypass valve 1581 and the second bypass valve 1582 are installed at an inner side of the inner wall portion 1516, the inner cover portion 1653 may be prevented from interfering with the first bypass valve 1581 and the second bypass valve 1582 when the floating plate 165 is lowered.

When the inner cover portion 1653 is internally fitted to the inner wall portion 1516, an inner cover member (hereinafter, a "second sealing member") 1662 may be inserted in an outer circumferential surface of the inner cover portion 1653. For example, an inner sealing groove (hereinafter, a "second sealing groove") 1653*a* may be formed in an annular shape on the outer circumferential surface of the inner cover portion 1653, and the second sealing member 1662 may be inserted in the second sealing groove 1653*a*. Like the first sealing member 1661, the second sealing member 1662 may be configured as a sealing member having elasticity, such as an O-ring.

The second sealing member 1662 may be provided on the inner circumferential surface of the inner wall portion 1516 facing the outer circumferential surface of the inner cover portion 1653. However, like the first sealing groove 1652*a* described above, it may be advantageous in terms of processing roughness to form the second sealing groove 1653*a* also on the inner cover portion 1653 of the floating plate 165.

As the second sealing member 1662 is located adjacent to the discharge port, a separate upper cover member may be provided in the second sealing groove 1653*a*. In other words, as a pressure difference between a periphery of the discharge port 1511 and an inner portion of the back pressure chamber S is large in the inner cover portion 1653 where the second sealing member 1662 is located, high-temperature and high-pressure refrigerant discharged through the discharge port 1511 may be introduced into the back pressure chamber S. Accordingly, high-temperature refrigerant may contact the second sealing member 1662 hardening the second sealing member 1662 or reducing a sealing force. For this reason, the upper cover member 1663 may be installed to cover an open surface of the second sealing groove 1653*a* that accommodates the second sealing member 1662 therein.

The upper cover member 1663 may be generally formed of a Teflon material, and have an annular shape like the second sealing member 1662. Accordingly, like the second sealing member 1662, inserting the upper cover member 1663 into an inner circumferential surface of the inner cover portion 1653 rather than inserting the upper cover member 1663 into the outer circumferential surface of the inner cover portion 1653 may be advantageous in terms of the assembly process.

Referring back to FIGS. 2 to 4, the valve accommodating portion 1654 may serve to slidably accommodate the discharge valve 157 that opens and closes the discharge port 1511, and the valve accommodating portion 1654 may be radially spaced apart from an inner side of the inner wall portion 1516, more specifically, an inner circumferential side of the inner cover portion 1653 with a predetermined gap therebetween. The valve accommodating portion 1654 may correspond in shape to discharge valve 157. For example, as the discharge valve 157 according to this embodiment is configured as a piston valve formed in a cylindrical shape, the valve accommodating portion 1654 may also be formed in a cylindrical shape.

More specifically, the valve accommodating portion 1654 may include a valve guide surface 1654*a* and a valve constraint surface 1654*b*. The valve guide surface 1654*a* may be formed in a cylindrical shape extending in the axial direction and having an inner diameter greater than an outer diameter of the discharge valve 157. Accordingly, an outer circumferential surface of the discharge valve 157 may be slidably fitted to an inner circumferential surface of the valve guide surface 1654*a*. However, the shape of the valve guide surface 1654*a* may vary depending on the shape of the discharge valve 157.

Referring to FIGS. 6 and 8, a lower end of the valve guide surface 1654*a* may be spaced apart from the upper surface of the non-orbiting end plate 151 facing the lower end of the valve guide surface 1654*a* with a predetermined gap therebetween, and at least a portion of each of the first bypass valve 1581 and the second bypass valve 1582 described above may be installed between the lower end of the valve guide surface 1654*a* and the upper surface of the non-orbiting end plate 151 facing the lower end of the valve guide surface 1654*a*.

A height H5 of the valve guide surface (or a height of the valve accommodating portion) may be formed to such an extent that the discharge valve 157 does not deviate from the valve guide surface 1654*a* even in a state at which the floating plate 165 is moved up to a highest level and the discharge valve 157 is moved down to a lowest level. For example, the height (or an axial length) H5 of the valve guide surface 1654*a* may be greater than or equal to a movement length of the discharge valve 157, namely, the height H4 of the inner cover portion 1653.

The valve constraint surface 1654*b* may radially extend from the inner circumferential surface of the inner cover portion 1653 by a connection portion 1656 to cover an upper end of the valve guide surface 1654*a*. A backflow prevention hole 1654*c* that provides communication between an inner portion of the valve guide surface 1654*a* and the high-pressure portion 110*b* may be provided at a center of the valve constraint surface 1654*b*. Accordingly, when the discharge valve 157 moves up, fluid resistance at an upper side of the discharge valve 157 may be reduced so that the valve rises quickly, whereas when the discharge valve 157 moves down, gas from the high-pressure portion 110*b* presses an upper surface of the valve 157 to quickly lower the valve.

The discharge through hole 1655 may serve to guide the refrigerant discharged from the compression chamber V through the discharge port 1511 to the high-pressure portion 110*b*. Accordingly, the discharge through hole 1655 may be formed through the floating plate 165 at the inner side of the sealing protrusion 1651*a*. More specifically, the discharge through hole 1655 may extend through the floating plate 165 between the inner circumferential surface of the inner cover portion 1653 and an outer circumferential surface of the valve accommodating portion 1654.

A plurality of the discharge through hole 1655 may be provided in an arc shape to be disposed along the circumferential direction. Accordingly, the connection portion 1656 may be formed between the plurality of discharge through holes 1655 in the radial direction, and the upper cover portion 1651 may be integrally connected with the valve accommodating portion 1654 by the connection portion 1656.

A circumferential length (or a total cross-sectional area) of the discharge through hole 1655 may be longer than a circumferential length (or a total cross-sectional area) of the connection portion 1656. This may secure a sufficient area of the discharge through hole 1655.

Figure 9:
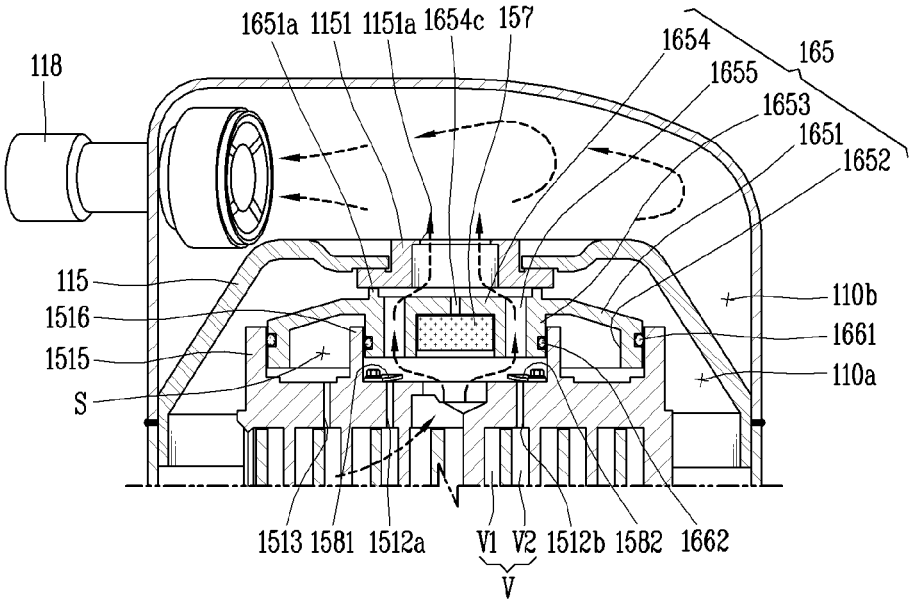
FIG. 9 is a cross-sectional view illustrating an operating state of the scroll compressor of FIG. 1.
Figure 10:
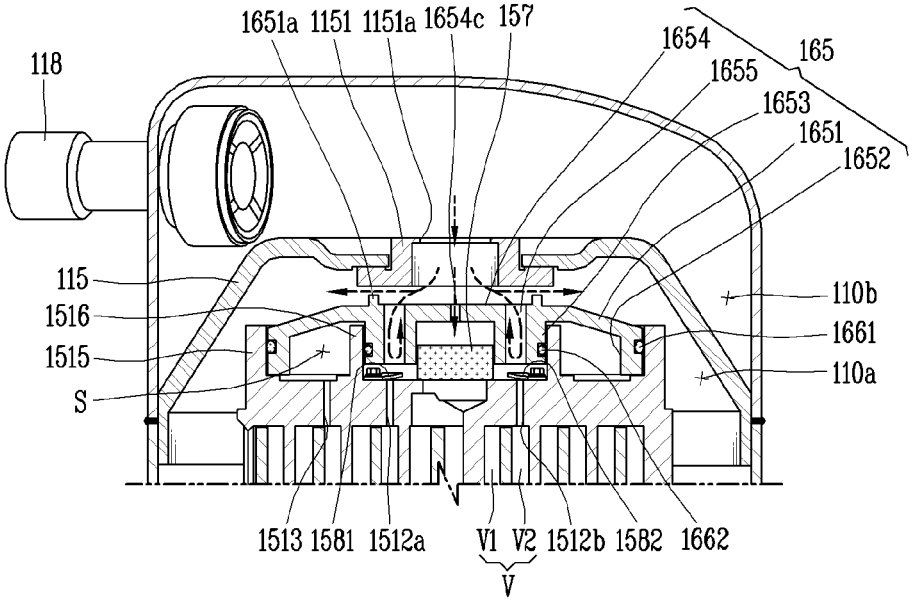
FIG. 10 is a cross-sectional view illustrating a stopped state of the scroll compressor of FIG. 1.

The scroll compressor according to this embodiment may operate as follows. FIG. 9 is a cross-sectional view illustrating an operating state of the scroll compressor of FIG. 1, and FIG. 10 is a cross-sectional view illustrating a stopped state of the scroll compressor of FIG. 1.

Referring to FIG. 9, when power is applied to the stator coil 1212 of the stator 121 during operation of the compressor, the rotor 122 may rotate together with the rotational shaft 125. Then, the orbiting scroll 140 coupled to the rotational shaft 125 may perform orbiting motion with respect to the non-orbiting scroll 150, thereby forming a pair of compression chambers V between the orbiting wrap 142 and the non-orbiting wrap 153. The compression chamber V may gradually decrease in volume while moving from outside to inside according to the orbiting motion of the orbiting scroll 140.

At this time, the refrigerant may be suctioned into the low pressure portion 110*a* of the casing 110 through the refrigerant suction pipe 117. A portion of this refrigerant may be suctioned directly into the suction pressure chambers of the first compression chamber V1 and the second compression chamber V2, respectively, while the rest of the refrigerant may first flow toward the drive motor 120 and then be suctioned into the suction pressure chambers.

Then, the refrigerant may be compressed while moving along a movement path of the compression chamber V. A portion of the compressed refrigerant may move toward the back pressure chamber S through the back pressure hole 1513 before reaching the discharge port 1511. Accordingly, the back pressure chamber S formed by the non-orbiting end plate 151 and the floating plate 165 may form an intermediate pressure.

The floating plate 165 may be pushed up by a pressure of the back pressure chamber S toward the high and low pressure separation plate 115, and the sealing protrusion 1651*a* provided on an upper end of the floating plate 165 may be brought into close contact with the sealing plate 1151 provided at the high and low pressure separation plate 115.

Accordingly, the high-pressure portion 110*b* of the casing 110 may be separated from the low-pressure portion 110*a*, and this may prevent the refrigerant discharged from the compression chambers V1 and V2 to the high-pressure portion 110*b* from flowing back into the low-pressure portion 110*a*.

The outer cover portion 1652 of the floating plate 165 may be provided with the first sealing member 1661 and the outer circumferential surface of the inner cover portion 1653 may be provided with the second sealing member 1662 to tightly seal the outer wall portion 1515 and the inner wall portion 1516 of the non-orbiting scroll 150, to thereby maintain a state in which an inner space of the back pressure chamber S is separated from the low-pressure portion 110*a* of the casing 110.

On the other hand, the non-orbiting scroll 150 may be pushed down toward the orbiting scroll 140 by the pressure of the back pressure chamber S, so as to be brought into close contact with the orbiting scroll 140. Accordingly, the refrigerant compressed in the compression chamber V may be prevented from leaking from a high-pressure side compression chamber to a low-pressure side compression chamber.

The refrigerant may be compressed up to a predetermined pressure while moving from the intermediate pressure chamber including the compression chambers V1 and V2 toward the discharge pressure chamber, but the pressure of the refrigerant may rise above the predetermined pressure due to other conditions occurring during operation of the compressor. Then, a portion of the refrigerant moving from the intermediate pressure chamber to the discharge pressure chamber may be bypassed to the high-pressure portion 110*b* in the intermediate pressure chamber including the compression chambers V1 and V2 through the first bypass hole 1512*a* and the second bypass hole 1512*b* before reaching the discharge pressure chamber. This may suppress the refrigerant from being over compressed above the predetermined pressure in the compression chambers V1 and V2, thereby enhancing compressor efficiency and ensuring stability.

The refrigerant moved to the discharge pressure chamber of each of the compression chambers V1 and V2 may be discharged to the high-pressure portion 110*b* through the discharge port 1511 and the discharge through hole 1655 while pushing the discharge valve 157, and the refrigerant may then flow into the high-pressure portion 110*b* so as to be discharged through a condenser of a refrigeration cycle through the refrigerant discharge pipe 118.

Referring to FIG. 10, during stoppage of the compressor, the pressure in the intermediate pressure chamber communicating with the back pressure hole 1513 may be reduced to thereby reduce the pressure in the back pressure chamber S, and as the pressure in the back pressure chamber S is reduced, the floating plate 165 may be moved down in a direction toward the non-orbiting scroll 150. Then, the sealing protrusion 1651*a* of the floating plate 165 may be spaced apart from the sealing plate 1151 of the high and low pressure separation plate 115 to allow the low-pressure portion 110*a* and the high-pressure portion 110*b* to communicate with each other. Then, the refrigerant in the high-pressure portion 110*b* may leak into the low-pressure portion 110*a* to achieve a flat pressure between the high-pressure portion 110*b* and the low-pressure portion 110*a*.

At this time, the pressure in the compression chamber V may be reduced to thereby weaken the force pushing up the discharge valve 157, whereas the high-pressure refrigerant in the high-pressure portion 110*b* at the upper surface of the discharge valve 157 may be introduced into the valve accommodating portion 1654 through the backflow prevention hole 1654*c* to form high pressure. Then, the discharge valve 157 may be pushed down by the refrigerant from the high-pressure portion 110*b* to block the discharge port 1511. This may block a reverse flow of the refrigerant from the high-pressure portion 110*a* into the compression chamber V.

As described above, as the outer wall portion 1515 and the inner wall portion 1516 forming the back pressure chamber S are integrally formed on the upper surface of the non-orbiting scroll 150, the number of components may be reduced compared to separately manufacturing and assembling a back pressure chamber assembly, and this may reduce the number of assemblers and/or assembly steps to thereby reduce manufacturing costs.

In addition, as the floating plate 165 provided between the outer wall portion 1515 and the inner wall portion 1516 to form the back pressure chamber S is further provided with the valve accommodating portion 1654 to accommodate the discharge valve 157, the bypass valves 1581 and 1582 may be installed inside of the inner wall portion 1516 of the non-orbiting scroll 150 without having to separately assemble the back pressure chamber. In addition, as the non-orbiting scroll 150 is formed of cast iron and the floating plate 165 is formed of an aluminum material, the sealing grooves 1652*a* and 1653*a* may be formed on the floating plate 165 having relatively high processing roughness to accommodate the sealing members 1661 and 1662 therein. Accordingly, not only the sealing grooves 1652*a* and 1653*a* may be easily processed, but also the processing roughness of the sealing grooves 1652*a* and 1653*a* may be increased to enhance an assembly degree of the sealing members 1661 and 1662 and the upper cover member 1663, thereby increasing a sealing degree of the back pressure chamber S.

In addition, as the inner cover portion 1653 of the floating plate 165 is internally fitted to the inner wall portion 1516 of the non-orbiting scroll 150, the annular sealing member 1662 that seals between the inner cover portion 1653 and the inner wall portion 1516 may be installed on the outer circumferential surface of the inner cover portion 1653. This may allow the annular sealing member 1662 to be easily installed.

Hereinafter, description will be given of another embodiment of the floating plate. In the previous embodiment, the outer cover portion of the floating plate is fitted to the inner circumferential side of the outer wall portion of the non-orbiting scroll, and the inner cover portion of the floating plate is fitted to the inner circumferential side of the inner wall portion, respectively. However, in some cases, the outer cover portion may be fitted to the inner circumferential side of the outer wall portion and the inner cover portion may be fitted to the outer circumferential side of the inner wall portion, respectively.

Figure 11:
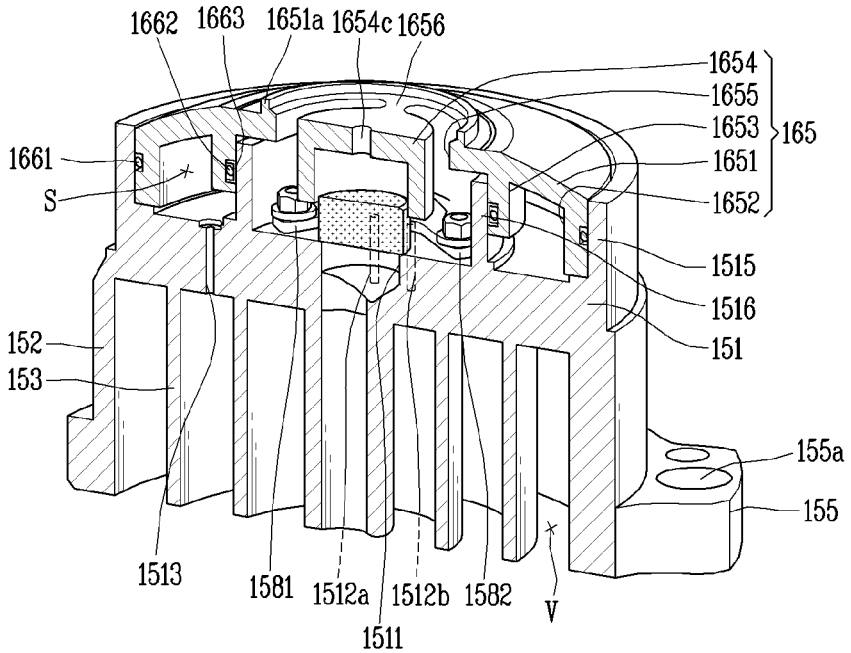
FIG. 11 is a perspective cross-sectional view.
Figure 12:
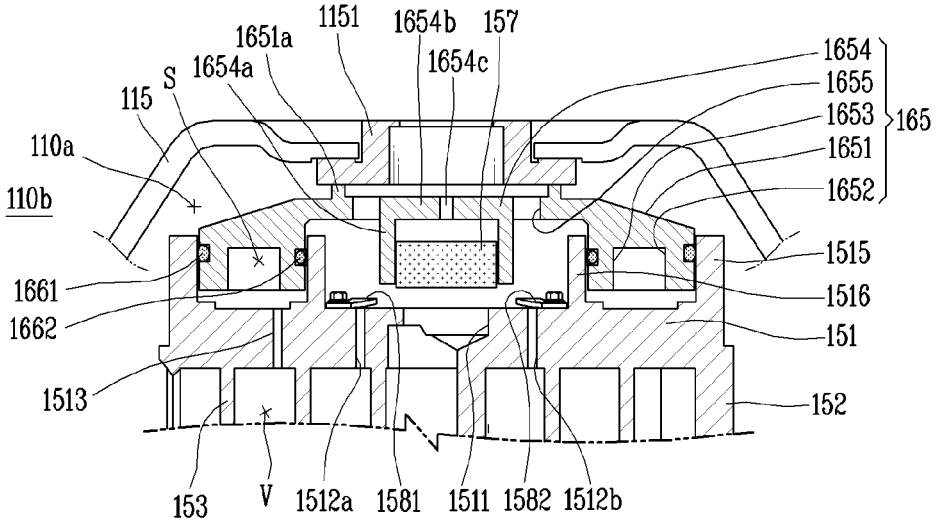
FIG. 12 is a cross-sectional view of a floating plate according to another embodiment.

FIG. 11 is a perspective cross-sectional view and FIG. 12 is a cross-sectional view of a floating plate according to another embodiment. Referring to FIGS. 11 and 12, non-orbiting scroll 150 according to this embodiment may be integrally formed by extending outer wall portion 1515 and inner wall portion 1516 from an upper surface of non-orbiting end plate 151.

The outer wall portion 1515 and the inner wall portion 1516 may be formed substantially the same as in the embodiment of FIG. 4 described above. For example, the outer wall portion 1515 and the inner wall portion 1516 may be spaced apart with a predetermined gap therebetween in the radial direction, and a height and a thickness of the outer wall portion 1515 may be approximately the same as a height and a thickness of the inner wall portion 1516. In addition, the outer wall portion 1515 may be formed as close to an outer circumferential surface of the non-orbiting end plate 151 as possible, while the inner wall portion 1516 may be formed as close to discharge port 1511 as possible within a range in which first bypass hole 1512*a* and second bypass hole 1512*b* may be formed.

Floating plate 165 according to this embodiment may be formed substantially similarly to the embodiment of FIG. 4 described above. More specifically, the floating plate 165 may include upper cover portion 1651, outer cover portion 1652, inner cover portion 1653, valve accommodating portion 1654, and discharge through hole 1655. The upper cover portion 1651, the outer cover portion 1652, the inner cover portion 1653, the valve accommodating portion 1654, and the discharge through hole 1655 may be formed substantially the same as in the embodiment of FIG. 4.

However, the outer cover portion 1652 may be slidably fitted to an inner circumferential surface of the outer wall portion 1515 (or internally fitted to the inner circumferential surface), while the inner cover portion 1653 may be slidably fitted to an outer circumferential surface of the inner wall portion 1516 (or externally fitted to the outer circumferential surface).

In other words, both the outer cover portion 1652 and the inner cover portion 1653 may be located inside of the outer wall portion 1515 and the inner wall portion 1516 forming back pressure chamber S. Accordingly, a gap between the outer cover portion 1652 and the inner cover portion 1653 may be narrower than the above-described embodiment of FIG. 4.

Also, in this case, first sealing member 1661 may be installed on an outer circumferential surface of the outer cover portion 1652, and second sealing member 1662 may be installed on an inner circumferential surface of the inner cover portion 1653, respectively. In particular, the second sealing member 1662 may be inserted in second sealing groove 1653*a* formed on the inner circumferential surface of the inner cover portion 1653 from an inner circumferential side. Accordingly, the second sealing member 1662 having an annular shape, like an O-ring may be inserted into the second sealing groove 1653*a* by shrinking instead of stretching, thereby allowing the second sealing member 1662 to be easily installed.

As described above, when the inner cover portion 1653 is externally fitted to an outer circumferential side of the inner wall portion 1516, a gap between the outer cover portion 1652 and the inner cover portion 1653 is reduced, so that an area supporting the floating plate 165, namely, an area of the floating plate 165 exposed to the back pressure chamber S (hereinafter, defined as a back pressure area of the back pressure chamber) may be reduced. In particular, when the outer cover portion 1652 is internally fitted to the outer wall portion 1515 and the inner cover portion 1653 is externally fitted to the outer circumferential side of the inner wall portion 1516 as in this embodiment, the outer cover portion 1652 and the inner cover portion 1653 both may be placed inside of the back pressure chamber. Accordingly, the back pressure area of the floating plate 165 may be reduced by approximately a thickness of the inner wall portion 1515 or a thickness of the inner cover portion 1653 compared to the embodiment of FIG. 4.

This may reduce a back pressure supporting the floating plate 165 so as to quickly move down the floating plate 165 during stoppage of a compressor, and therefore, a flat pressure between low-pressure portion 110*a* and high-pressure portion 110*b* may be quickly and smoothly achieved. In addition, as the inner cover portion 1653 is externally fitted to the inner wall portion 1516 as in this embodiment, a cross section of the inner cover portion 1653 may be excluded from a periphery of the discharge port 1511 to thereby form a discharge passage flat without curves. This allows refrigerant passing through the discharge port 1511 to move to the discharge through hole 1655 along the inner circumferential surface of the flat inner wall portion 1516, so that flow loss due to a vortex in the vicinity of the discharge port 1511 is prevented.

In addition, in this embodiment, the floating plate 165 including the inner cover portion 1653 is formed of an aluminum material, and thus, has a relatively high processing roughness compared to the inner wall portion 1516 formed of cast iron. Accordingly, when the second sealing member 1662 is inserted in the second sealing groove 1653*a* formed on the inner circumferential surface of the inner cover portion 1653, a sealing force of the second sealing member 1662 inserted in the second sealing groove 1653*a* may be improved due to high processing roughness of the second sealing groove 1653*a*. In addition, as the second sealing member 1662 and upper cover member 1663 formed in an annular shape as in this embodiment are installed on the inner circumferential surface of the inner cover portion 1653, the second sealing member 1662 and the upper cover member 1663 may be easily installed.

Hereinafter, description will be given of still another embodiment of the floating plate.

Figure 13:
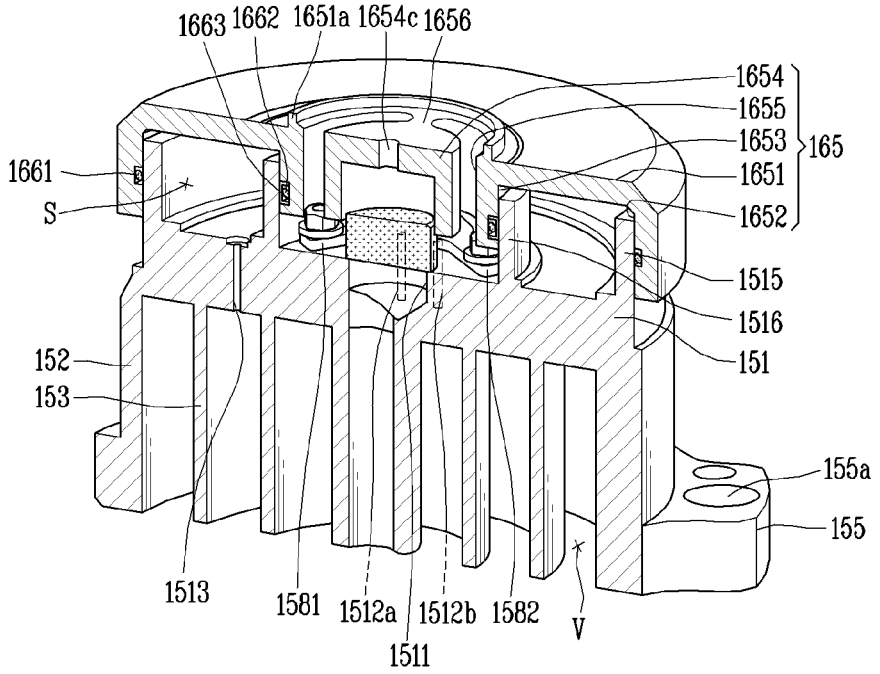
FIG. 13 is a perspective cross-sectional view.

In the previous embodiment, the outer cover portion is slidably fitted to the inner circumferential surface of the outer wall portion, but in some cases, the outer cover portion may be slidably fitted to the outer circumferential surface of the outer wall portion. FIG. 13 is a perspective cross-sectional view and FIG. 14 is a cross-sectional view of a floating plate according to still another embodiment.

Figure 14:
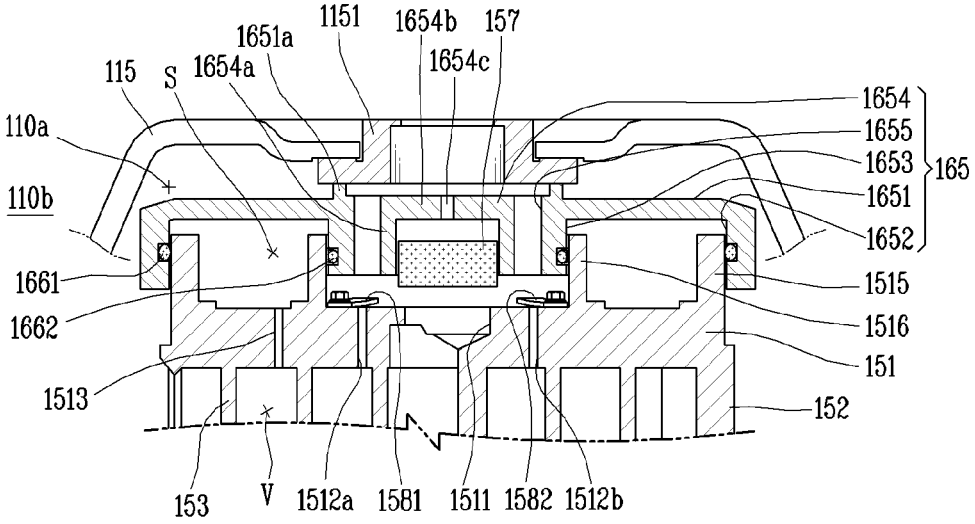
FIG. 14 is a cross-sectional view of a floating plate according to still another embodiment.

Referring to FIGS. 13 and 14, non-orbiting scroll 150 according to this embodiment may be formed by integrally extending outer wall portion 1515 and inner wall portion 1516 from an upper surface of non-orbiting end plate 151. The outer wall portion 1515 and the inner wall portion 1516 may be formed substantially the same as in the embodiment of FIG. 4 described above. For example, the outer wall portion 1515 and the inner wall portion 1516 may be spaced apart with a predetermined gap therebetween in the radial direction, and a height and a thickness of the outer wall portion 1515 may be approximately the same as a height and a thickness of the inner wall portion 1516. In addition, the outer wall portion 1515 may be formed as close to an outer circumferential surface of the non-orbiting end plate 151 as possible, while the inner wall portion 1516 may be formed as close to discharge port 1511 as possible within a range in which first bypass hole 1512*a* and a second bypass hole 1512*b* may be formed.

Floating plate 165 according to this embodiment may be formed substantially similarly to the embodiment of FIG. 4 described above. More specifically, the floating plate 165 may include upper cover portion 1651, outer cover portion 1652, inner cover portion 1653, valve accommodating portion 1654, and discharge through hole 1655. The upper cover portion 1651, the outer cover portion 1652, the inner cover portion 1653, the valve accommodating portion 1654, and the discharge through hole 1655 may be formed substantially similarly to the embodiment of FIG. 4.

However, an arrangement in which the floating plate 165 is assembled to the outer wall portion 1515 and the inner wall portion 1516 of the non-orbiting scroll 150 may be opposite to that of the embodiment of FIG. 9. For example, the outer cover portion 1652 may be slidably fitted to an outer circumferential surface of the outer wall portion 1515 (or externally fitted to the outer circumferential surface), while the inner cover portion 1653 may be slidably fitted to an inner circumferential surface of the inner wall portion 1516 (or internally fitted to the inner circumferential surface).

In other words, both the outer cover portion 1652 and the inner cover portion 1653 may be located outside of the outer wall portion 1515 and the inner wall portion 1516 forming back pressure chamber S. Accordingly, a gap between the outer cover portion 1652 and the inner cover portion 1653 may be wider than the previous embodiments of FIGS. 4 and 11.

Also, in this case, first sealing member 1661 may be installed on an inner circumferential surface of the outer cover portion 1652, and second sealing member 1662 may be installed on an outer circumferential surface of the inner cover portion 1653, respectively. In particular, the first sealing member 1661 may be inserted in first sealing groove 1652*a* formed on the inner circumferential surface of the outer cover portion 1652 from an inner circumferential side. Accordingly, the first sealing member 1661 having an annular shape, like an O-ring, may be inserted into the first sealing groove 1652*a* by shrinking instead of stretching, thereby allowing the first sealing member 1661 to be easily installed.

Even when the outer cover portion 1652 is externally fitted to the outer wall portion 1515 as described above, the basic configuration and effects thereof may be similar to the embodiments of FIGS. 4 and 11 described above. However, in this embodiment, the back pressure area of the back pressure chamber S supporting the floating plate 165 may be increased because the gap between the outer cover portion 1652 and the inner cover portion 1653 is widened. Accordingly, during operation of a compressor, the floating plate 165 may be quickly elevated to be strongly adhered to the high and low pressure separation plate, thereby providing a tightly seal between low-pressure portion 110*a* and high-pressure portion 110*b*.

Hereinafter, description will be given of a back pressure chamber portion according to another embodiment. In the previous embodiments, the outer wall portion and the inner wall portion forming a portion of the back pressure chamber are integrally formed with the non-orbiting scroll, but in some cases, the back pressure chamber may be formed by post-assembly of a separate back pressure chamber assembly including the outer wall portion and the inner wall portion to the non-orbiting scroll.

Figure 15:
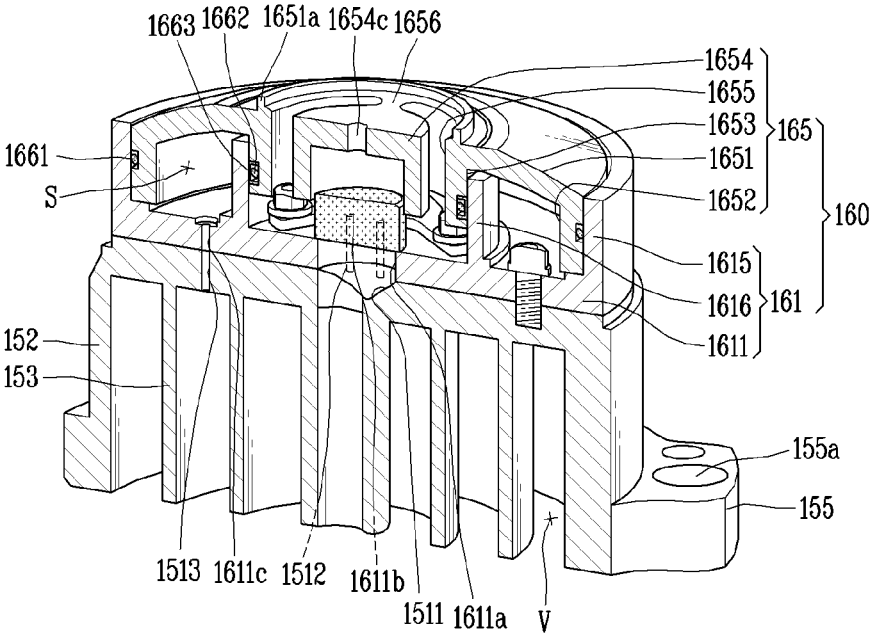
FIG. 15 is a perspective cross-sectional view.
Figure 16:
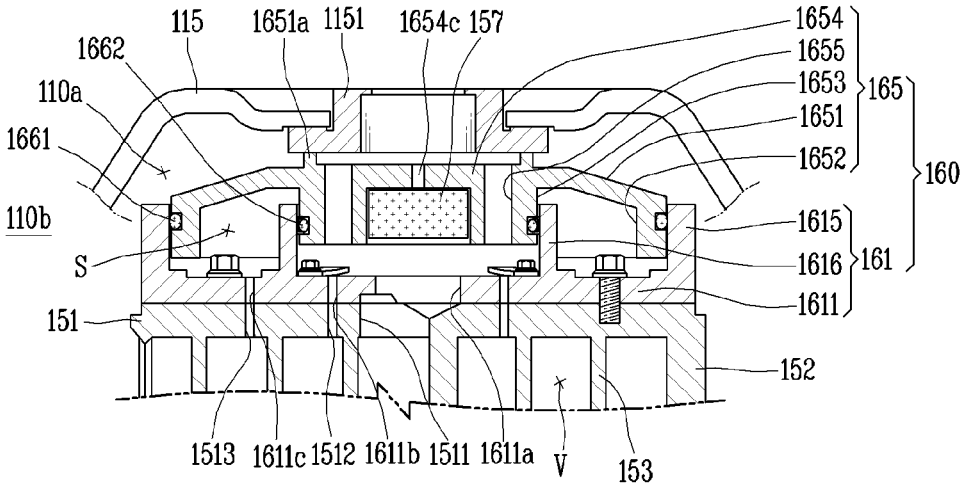
FIG. 16 is a cross-sectional view of a back pressure chamber according to another embodiment.

FIG. 15 is a perspective cross-sectional view and FIG. 16 is a cross-sectional view of a back pressure chamber according to another embodiment. Referring to FIGS. 15 and 16, the back pressure chamber according to this embodiment may be formed in back pressure chamber assembly 160 coupled to an upper surface of non-orbiting scroll 150.

The back pressure chamber assembly 160 forming the back pressure chamber may include back pressure plate 161 and floating plate 165. The non-orbiting scroll 150 according to this embodiment may include non-orbiting end plate 151, and the non-orbiting end plate 151 may include a first end plate (no reference numeral) and a second end plate (no reference numeral) separately manufactured to be post-assembled. The first end plate may be understood as a lower end plate provided with non-orbiting wrap 153 to form compression chamber V, and the second end plate may be understood as an upper end plate included in back pressure plate 161 forming a portion of the back pressure chamber assembly 160 to form back pressure chamber S.

The back pressure plate 161 including the second end plate may have an annular shape, and an outer wall portion 1615 and inner wall portion 1616 may be formed on an upper surface of fixed plate portion 1611 with a predetermined gap therebetween in the radial direction. An upper surface between outer wall portion 1515 and inner wall portion 1516 may be covered by the floating plate 165. Accordingly, the back pressure chamber S may be formed in a space between the outer wall portion 1615 and the inner wall portion 1616.

Bottom plate portion 1611 between the outer wall portion 1615 and the inner wall portion 1616 may be provided with plate side back pressure hole 1611*c* formed therethrough, and the non-orbiting scroll 150 may be provided with scroll side back pressure hole 1513 that communicates with the plate side back pressure hole 1611*c*. Another end of the scroll side back pressure hole 1513 may communicate with an intermediate pressure chamber.

The outer wall portion 1515 and the inner wall portion 1516 may be formed in the same manner as in the previous embodiments. For example, the outer wall portion 1515 may extend toward high and low pressure separation plate 115 from a rim of the non-orbiting end plate 151, and the inner wall portion 1516 may extend in the axial direction from a central portion of the non-orbiting end plate 151, more specifically, from a portion between the outer wall portion 1515 and plate-side bypass hole 1611*b* toward the high and low pressure separation plate 115. The plate-side bypass hole 1611*b* may communicate with scroll-side bypass hole 1512.A plate-side discharge port 1611*a* may be formed at a central portion of the back pressure plate to communicate with discharge port 1511 of the non-orbiting scroll 150.

The floating plate 165 may be formed in the same manner as in the previous embodiments. For example, the floating plate 165 may include upper cover portion 1651, outer cover portion 1652, inner cover portion 1653, valve accommodating portion 1654, and discharge through hole 1655. Respective description of the upper cover portion 1651, the outer cover portion 1652, the inner cover portion 1653, the valve accommodating portion 1654, and the discharge through hole 1655 has been omitted.

When the back pressure chamber assembly 160 is assembled to the non-orbiting scroll 150 as described above, the back pressure plate 161 forming a portion of the back pressure chamber assembly 160 may be formed of an aluminum material. Accordingly, a weight of the non-orbiting scroll 150 may be reduced compared to a case in which the back pressure plate 161 including the outer wall portion 1615 and the inner wall portion 1616, and the bottom plate portion 1611 connecting the outer wall portion 1615 and the inner wall portion 1616 are integrally formed with the non-orbiting scroll 150.

In addition, as the non-orbiting scroll 150 is formed by precision machining the non-orbiting wrap 153 on one surface of the non-orbiting scroll 150, an entire processing of the non-orbiting scroll 150 may be difficult when the outer wall portion 1615 and the inner wall portion 1616 which require precision machining are integrally formed on another surface of the non-orbiting scroll 150. Accordingly, when the back pressure chamber assembly 160 is assembled while being separated from the non-orbiting scroll 150, the non-orbiting scroll 150 may be easily manufactured. In addition, when the back pressure plate 161 included in the back pressure chamber assembly 160 is made of an aluminum material, this may ease the precision machining of the outer wall portion 1615 and secure high roughness with respect to circumferential surfaces of the outer wall portion 1615 and the inner wall portion 1616 to thereby increase a degree of sealing with the floating plate 165.

In addition, when the back pressure plate 161 is made of an aluminum material, the sealing groove in the previous embodiments may be easily formed on a circumferential surface of the back pressure plate 161, namely, on a circumferential surface of the outer wall portion 1615 or a circumferential surface the inner wall portion 1616. Accordingly, sealing members 1661 and 1662 and upper cover member 1663 may be easily assembled.

Meanwhile, in the previous embodiments, a case in which the discharge valve is configured as a piston valve has been described as an example, but in some cases, the discharge valve may be configured as a reed valve in which one or a first end thereof is a fixed end and another or a second end thereof is a free end. Even in this case, positions and shapes of the outer wall portion and the inner wall portion may be the same as in the previous embodiments, and the floating plate may be formed in the same manner as in the previous embodiments except for the valve accommodating portion. The basic structure and operation effects of this embodiment are the same as or similar to those of the previous embodiments, and thus, repetitive description thereof has been omitted.

Embodiments disclosed herein provide a scroll compressor capable of simplifying a structure of a back pressure chamber in a non-orbiting back pressure method in which the back pressure chamber is formed on a rear surface of a non-orbiting scroll provided with a discharge port and a bypass hole. In addition, embodiments disclosed herein provide a scroll compressor in which a portion forming back pressure chamber is integrally formed with a non-orbiting scroll, thereby reducing the number of components and assemblers or assembly steps.

Further, embodiments disclosed herein provide a scroll compressor in which an area of a back pressure chamber may be secured while a portion forming a back pressure chamber is integrally formed with a non-orbiting scroll. Furthermore, embodiments disclosed herein provide a scroll compressor in which a degree of sealing of a back pressure chamber may be secured while a portion forming a back pressure chamber is integrally formed with a non-orbiting scroll.

In addition, embodiments disclosed herein provide a scroll compressor in which a sealing member for sealing a back pressure chamber may be easily assembled while a portion forming a back pressure chamber is integrally formed with a non-orbiting scroll. Also, embodiments disclosed herein provide a scroll compressor capable of reducing the number of components forming a back pressure chamber and the number of assemblers or assembly steps therefor when a discharge valve for opening and closing a discharge port is configured as a piston valve.

According to embodiments disclosed herein, in the non-orbiting back pressure method in which a back pressure chamber is formed on a rear surface of a non-orbiting scroll, an outer wall portion and an inner wall portion forming a portion of the back pressure chamber may extend integrally from the rear surface of the non-orbiting scroll. Accordingly, the number of components forming the back pressure chamber and the number of assemblers or assembly steps therefor may be reduced in the non-orbiting back pressure method to thereby reduce manufacturing costs.

The non-orbiting scroll may have a discharge port and a bypass hole that communicates with a compression chamber, and the discharge port and the bypass hole may be formed at an inner side than the inner wall portion. Accordingly, the inner wall portion forming a portion of the back pressure chamber may be integrally formed with the non-orbiting scroll.

A floating plate between the outer wall portion and the inner wall portion may be further provided on an upper side of the non-orbiting scroll. The floating plate may include an outer cover portion that slidingly contacts the outer wall portion and an inner cover portion that slidingly contacts the inner wall portion. Accordingly, an area of the back pressure chamber may be secured by adjusting positions of the outer cover portion and the inner cover portion.

In addition, the floating plate may be made of a material having better processability than the non-orbiting scroll. An annular sealing groove may be formed on the outer cover portion or the inner cover portion, and an annular sealing member may be inserted in the sealing groove. This may increase processing roughness of the sealing groove, thereby enhancing a degree of sealing between the outer cover portion and the outer wall portion or between the inner cover portion and the inner wall portion.

Further, the sealing member provided between the outer wall portion and the outer cover portion or between the inner wall portion and the inner cover portion may be installed on inner circumferential surfaces facing each other. As a result, assembly of the sealing member may be facilitated.

According to embodiments disclosed herein, a scroll compressor is provided that may include a casing having a sealed inner space, a drive motor installed in the inner space of the casing, an orbiting scroll coupled to the drive motor to perform an orbiting motion, a non-orbiting scroll provided with a compression chamber formed by being engaged with the orbiting scroll at one surface of an end plate, an outer wall portion and an inner wall portion having a predetermined gap between the outer wall portion and the inner wall portion in a radial direction and extending in an axial direction from another surface of the end plate, and a discharge port configured to discharge refrigerant compressed in the compression chamber into the inner space of the casing, and a floating plate to cover an area between the outer wall portion and the inner wall portion of the non-orbiting scroll so as to form a back pressure chamber with the non-orbiting scroll may be provided. The floating plate may include an upper cover portion having an annular shape to form an upper surface of the back pressure chamber, an outer cover portion that extends from an outer circumference of the upper cover portion toward the non-orbiting scroll in the axial direction so as to be slidably fitted to the outer wall portion, an inner cover portion that extends from an inner circumference of the upper cover portion toward the non-orbiting scroll in the axial direction so as to be slidably fitted to the inner wall portion, and a valve accommodating portion that axially extends from an inner circumferential side of the inner cover portion so as to accommodate a discharge valve configured to open and close the discharge port. This may simplify a structure of the back pressure chamber to thereby reduce manufacturing costs.

At least one discharge through hole may be provided between an outer circumferential surface of the valve accommodating portion and an inner circumferential surface of the inner cover portion to provide communication between the discharge port and the inner space of the casing. At least one connection portion may be provided between the outer circumferential surface of the valve accommodating portion and the inner circumferential surface of the inner cover portion to connect the valve accommodating portion and the inner cover portion. Accordingly, the valve accommodating portion may be integrally formed with the floating plate.

At least one discharge through hole may be provided between an outer circumferential surface of the valve accommodating portion and an inner circumferential surface of the inner cover portion to provide communication between the discharge port and the inner space of the casing. At least one connection portion may be provided between the discharge through holes to connect between the valve accommodating portion and the inner cover portion. A circumferential length of the discharge through hole may be longer than a circumferential length of the connection portion. In this way, a discharge area of the discharge through hole may be secured.

The valve accommodating portion may have a cylindrical shape, a plurality of connection portions may be spaced apart from each other along an outer circumferential surface of the valve accommodating portion, and a discharge through hole may be formed between the plurality of connection portions circumferentially adjacent to each other. Accordingly, the discharge through hole may be secured while the valve accommodating portion is integrally formed in the floating plate.

A lower end of the valve accommodating portion may be spaced apart from the another surface of the end plate of the non-orbiting scroll. Accordingly, a space for installing a bypass valve may be secured while the valve accommodating portion is formed in the floating plate.

A bypass hole to bypass refrigerant compressed in a compression chamber may be formed around the discharge port of the non-orbiting scroll. The another surface of the non-orbiting scroll may be provided with a bypass valve to open and close the bypass hole. The bypass valve may be placed between the non-orbiting scroll and the valve accommodating portion. This may allow a bypass valve to be installed between the non-orbiting scroll and the back pressure chamber while simplifying a structure of the non-orbiting scroll.

The valve guide surface may have a cylindrical shape. This may minimize an area of the vale accommodating portion to secure an installation space for the bypass valve.

The end plate of the non-orbiting scroll may be provided with a bypass hole to provide communication between the compression chamber and the inner space of the casing. The bypass hole may be formed between the discharge port and the inner wall portion in the radial direction. The another surface of the end plate of the non-orbiting scroll may be provided with a bypass valve to open and close the bypass hole. This may secure a space for the bypass hole and the bypass valve while simplifying a structure of the back pressure chamber.

The bypass valve may be located between the end plate of the non-orbiting scroll and the valve accommodating portion in the axial direction. Accordingly, the bypass valve may be installed between the discharge port and the inner wall portion.

The discharge valve may be configured as a piston valve axially sliding in the valve accommodating portion. An axial length of the valve accommodating portion may be longer than an axial movement length of the discharge valve. This may suppress removal of the discharge valve while allowing the valve accommodating portion to be spaced apart from the non-orbiting scroll.

The inner space of the casing may be provided with a high and low pressure separation plate to separate the inner space of the casing into a low-pressure portion and a high-pressure portion. A sealing protrusion that axially extends toward the high and low pressure separation plate may be provided between the upper cover portion and the inner cover portion. Accordingly, the valve accommodating portion may be integrally formed in the floating plate and refrigerant may be smoothly discharged toward the high-pressure portion.

The sealing protrusion may be formed on an axial line the same as that of the inner cover portion. Accordingly, the discharge through hole may be integrally formed in an inner portion of the sealing protrusion.

An axial length of the valve accommodating portion may be shorter than or equal to an axial length of the inner cover portion, and an end portion of the valve accommodating portion may be spaced apart from the end plate of the non-orbiting scroll. Accordingly, the valve accommodating portion may be formed in the floating plate while a bypass valve is installed between the floating plate and the non-orbiting scroll.

An outer cover member may be provided between a circumferential surface of the outer cover portion and a circumferential surface of the outer wall portion. An inner cover member may be provided between a circumferential surface of the inner cover portion and a circumferential surface of the inner wall portion. This may tightly seal between the outer wall portion and the inner wall portion forming a portion of the back pressure chamber portion.

The outer cover portion may be slidably fitted to an inner circumferential surface of the outer wall portion, and the inner cover portion may be slidably fitted to an inner circumferential surface of the inner wall portion. In this way, a back pressure area of the back pressure chamber may be secured.

An outer circumferential surface of the outer cover portion may have an annular outer sealing groove to receive an annular outer cover member. Accordingly, processing roughness of the sealing groove into which the sealing member is inserted may be increased.

An outer circumferential surface of the inner cover portion may have an annular inner sealing groove to receive an annular inner cover member. Accordingly, processing roughness of the sealing groove into which the sealing member is inserted may be increased.

The outer cover portion may be slidably fitted to an inner circumferential surface of the outer wall portion, and the inner cover portion may be slidably fitted to an outer circumferential surface of the inner wall portion. This may reduce the back pressure area of the back pressure chamber, so that when the compressor is stopped, the floating plate may quickly move down to achieve a flat pressure.

An outer circumferential surface of the outer cover portion may have an annular outer sealing groove to receive an annular outer cover member, and an inner circumferential surface of the inner cover portion may have an annular inner sealing groove to receive an annular inner cover member. This may allow the inner cover member to be easily installed while enhancing a sealing effect for the back pressure chamber.

The outer cover portion may be slidably fitted to an outer circumferential surface of the outer wall portion, and the inner cover portion may be slidably fitted to an inner circumferential surface of the inner wall portion. This may reduce the back pressure area of the back pressure chamber to allow the floating plate to be tightly brought into contact with the high and low pressure separation plate so as to tightly seal between the low-pressure portion and the high-pressure portion.

An inner circumferential surface of the outer cover portion may have an annular outer sealing groove to receive an annular outer cover member, and an outer circumferential surface of the inner cover portion may have an annular inner sealing groove to receive an annular inner cover member. This may allow the outer cover member to be easily installed while enhancing a sealing effect for the back pressure chamber.

The outer wall portion and the inner wall portion may integrally extend from the end plate of the non-orbiting scroll. Accordingly, the number of components forming the back pressure chamber and the number of assemblers and assembly steps may be reduced to simplify the back pressure chamber.

The non-orbiting scroll may include a first end plate provided with a non-orbiting wrap to form the compression chamber and a second end plate provided with the outer wall portion and the inner wall portion to form the back pressure chamber. The first end plate and the second end plate may be assembled together. In this way, a shape or components forming the back pressure chamber may be selectable as needed, thereby elevating a degree of freedom in design.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a nupmber of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a sealed inner space;

a drive motor installed in the inner space of the casing;

an orbiting scroll coupled to the drive motor to perform an orbiting motion;

a non-orbiting scroll including an end plate provided at a first side of the orbiting scroll and having a first surface defining a compression chamber by being engaged with the orbiting scroll and a second surface having an outer wall portion and an inner wall portion that extend in an axial direction with a predetermined gap therebetween in a radial direction, the inner wall portion provided therein with a discharge port configured to discharge refrigerant compressed in the compression chamber into the inner space of the casing; and a floating plate configured to cover an area between the outer wall portion and the inner wall portion of the non-orbiting scroll so as to form a back pressure chamber with the non-orbiting scroll, wherein the floating plate comprises:

an upper cover portion having an annular shape to form an upper surface of the back pressure chamber;

an outer cover portion that extends from an outer circumference of the upper cover portion toward the non-orbiting scroll in the axial direction so as to be slidably fitted to the outer wall portion;

an inner cover member that extends from an inner circumference of the upper cover portion toward the non-orbiting scroll in the axial direction so as to be slidably fitted to the inner wall portion; and a valve accommodating portion that axially extends from an inner circumferential side of the inner cover portion so as to accommodate a discharge valve configured to open and close the discharge port, wherein at least one discharge through hole is defined between an outer circumferential surface of the valve accommodating portion and an inner circumferential surface of the inner cover portion, so as to provide communication between the discharge port and the inner space of the casing, and wherein at least one connection portion is defined between the outer circumferential surface of the valve accommodating portion and the inner circumferential surface of the inner cover portion, so as to provide communication between the valve accommodating portion and the inner cover portion.

2. The scroll compressor of claim 1, wherein a circumferential length of the at least one discharge through hole is longer than a circumferential length of the at least one connection portion.

3. The scroll compressor of claim 1, wherein the valve accommodating portion has a cylindrical shape, wherein the at least one connection portion comprises a plurality of connection portions spaced apart from each other along the outer circumferential surface of the valve accommodating portion, and wherein the at least one discharge through hole comprises a discharge through hole defined between the plurality of connection portions adjacent to each other in a circumferential direction.

4. The scroll compressor of claim 1, wherein a lower end of the valve accommodating portion is spaced apart from the second surface of the end plate of the non-orbiting scroll.

5. The scroll compressor of claim 1, wherein the valve accommodating portion comprises a valve guide surface that extends in the axial direction and into which the discharge valve is slidably inserted, and a valve constraint surface that covers one end of the valve guide surface, and wherein the valve constraint surface is provided with a backflow prevention hole to provide communication between an inner portion of the valve guide surface and the inner space of the casing.

6. The scroll compressor of claim 5, wherein the valve guide surface has a cylindrical shape.

7. The scroll compressor of claim 1, wherein the end plate of the non-orbiting scroll is provided with at least one bypass hole to allow the compression chamber and the inner space of the casing to communicate with each other, wherein the at least one bypass hole is defined between the discharge port and the inner wall portion in the radial direction, and wherein the second surface of the end plate of the non-orbiting scroll is provided with a bypass valve to open and close the at least one bypass hole.

8. The scroll compressor of claim 7, wherein the bypass valve is disposed between the end plate of the non-orbiting scroll and the valve accommodating portion in the axial direction.

9. The scroll compressor of claim 1, wherein the discharge valve comprises a piston valve that axially slides in the valve accommodating portion, and wherein an axial length of the valve accommodating portion is longer than an axial movement length of the discharge valve.

10. The scroll compressor of claim 1, wherein the inner space of the casing is provided with a high and low pressure separation plate to separate the inner space of the casing into a low-pressure portion and a high-pressure portion, and wherein a sealing protrusion that axially extends toward the high and low pressure separation plate is provided between the upper cover portion and the inner cover portion.

11. The scroll compressor of claim 10, wherein the sealing protrusion is formed on a same axial line as the inner cover portion.

12. The scroll compressor of claim 1, wherein an axial length of the valve accommodating portion is shorter than or equal to an axial length of the inner cover portion, and wherein an end portion of the valve accommodating portion is spaced apart from the end plate of the non-orbiting scroll.

13. The scroll compressor of claim 1, wherein an outer cover member is provided between a circumferential surface of the outer cover portion and a circumferential surface of the outer wall portion facing each other, and wherein the inner cover member is provided between a circumferential surface of the inner cover portion and a circumferential surface of the inner wall portion facing each other.

14. The scroll compressor of claim 1, wherein the outer cover portion is slidably fitted to an inner circumferential surface of the outer wall portion, and wherein the inner cover portion is slidably fitted to an inner circumferential surface of the inner wall portion.

15. The scroll compressor of claim 14, wherein an outer circumferential surface of the outer cover portion has an outer sealing groove with an annular shape to receive an outer cover member having an annular shape, and wherein an outer circumferential surface of the inner cover portion has an inner sealing groove with an annular shape to receive the inner cover member having an annular shape.

16. The scroll compressor of claim 1, wherein the outer cover portion is slidably fitted to an inner circumferential surface of the outer wall portion, and wherein the inner cover portion is slidably fitted to an outer circumferential surface of the inner wall portion.

17. The scroll compressor of claim 16, wherein an outer circumferential surface of the outer cover portion has an outer sealing groove with an annular shape to receive an outer cover member having an annular shape, and wherein an inner circumferential surface of the inner cover portion has an inner sealing groove with an annular shape to receive an inner cover member having an annular shape.

18. The scroll compressor of claim 1, wherein the outer cover portion is slidably fitted to an outer circumferential surface of the outer wall portion, and wherein the inner cover portion is slidably fitted to an inner circumferential surface of the inner wall portion.

19. The scroll compressor of claim 18, wherein an inner circumferential surface of the outer cover portion has an outer sealing groove with an annular shape to receive an outer cover member having an annular shape, and wherein an outer circumferential surface of the inner cover portion has an inner sealing groove with an annular shape to receive an inner cover member having an annular shape.

20. The scroll compressor of claim 1, wherein the outer wall portion and the inner wall portion integrally extend from the end plate of the non-orbiting scroll.

21. The scroll compressor of claim 1, wherein the non-orbiting scroll comprises a first end plate provided with a non-orbiting wrap to form the compression chamber, and a second end plate provided with the outer wall portion and the inner wall portion to form the back pressure chamber, and wherein the first end plate and the second end plate are assembled together.

22. A scroll compressor, comprising:

a casing having a sealed inner space;

a drive motor installed in the inner space of the casing;

an orbiting scroll coupled to the drive motor to perform an orbiting motion;

a non-orbiting scroll including an end plate provided at a first side of the orbiting scroll and having a first surface defining a compression chamber by being engaged with the orbiting scroll and a second surface having an outer wall portion and an inner wall portion that extend in an axial direction with a predetermined gap therebetween in a radial direction, the inner wall portion provided therein with a discharge port configured to discharge refrigerant compressed in the compression chamber into the inner space of the casing; and a floating plate configured to cover an area between the outer wall portion and the inner wall portion of the non-orbiting scroll so as to form a back pressure chamber with the non-orbiting scroll, wherein the floating plate comprises:

an upper cover portion having an annular shape to form an upper surface of the back pressure chamber;

an outer cover portion that extends from an outer circumference of the upper cover portion toward the non-orbiting scroll in the axial direction so as to be slidably fitted to the outer wall portion;

an inner cover member that provides a seal between a circumferential surface of the inner cover portion and a circumferential surface of the inner wall portion facing each other;

an outer cover member that provides a seal between a circumferential surface of the outer cover portion and a circumferential surface of the outer wall portion facing each other; and a valve accommodating portion that axially extends from an inner circumferential side of the inner cover portion so as to accommodate a discharge valve configured to open and close the discharge port, wherein a lower end of the valve accommodating portion is spaced apart from the second surface of the end plate of the non-orbiting scroll.

23. A scroll compressor, comprising:

a casing having a sealed inner space;

a drive motor installed in the inner space of the casing;

an orbiting scroll coupled to the drive motor to perform an orbiting motion;

a non-orbiting scroll including an end plate provided at a first side of the orbiting scroll and having a first surface defining a compression chamber by being engaged with the orbiting scroll and a second surface having an outer wall portion and an inner wall portion that extend in an axial direction with a predetermined gap therebetween in a radial direction, the inner wall portion of the non-orbiting scroll provided therein with a discharge port configured to discharge refrigerant compressed in the compression chamber into the inner space of the casing; and a floating plate configured to cover an area between the outer wall portion of the non-orbiting scroll and the inner wall portion of the non-orbiting scroll so as to form a back pressure chamber with the non-orbiting scroll, wherein the floating plate comprises:

an upper cover portion having an annular shape to form an upper surface of the back pressure chamber;

an outer cover portion that extends from an outer circumference of the upper cover portion toward the non-orbiting scroll in the axial direction so as to be slidably fitted to the outer wall portion;

a first elastic sealing provided between a circumferential surface of the inner cover portion and a circumferential surface of the inner wall portion facing each other;

a second elastic sealing provided between a circumferential surface of the outer cover portion and a circumferential surface of the outer wall portion facing each other; and a valve accommodating portion that axially extends from an inner circumferential side of the inner cover portion so as to accommodate a discharge valve configured to open and close the discharge port, wherein the end plate of the non-orbiting scroll is provided with at least one bypass hole to allow the compression chamber and the inner space of the casing to communicate with each other, wherein the at least one bypass hole is defined between the discharge port and the inner wall portion in the radial direction, and wherein the second surface of the end plate of the non-orbiting scroll is provided with a bypass valve to open and close the at least one bypass hole.

* * * * *